US005410962A

United States Patent [19]

Collier

[11] Patent Number: 5,410,962

[45] Date of Patent: * May 2, 1995

[54] SPECIAL EFFECTS ROTATING RUBBER STAMP

[76] Inventor: Harry B. Collier, 1356 E. Goldsmith Dr., Highlands Ranch, Colo. 80126

[ * ] Notice: The portion of the term of this patent subsequent to Jan. 12, 2010 has been disclaimed.

[21] Appl. No.: 977,225

[22] Filed: Nov. 16, 1992

Related U.S. Application Data

[63] Continuation-in-part of Ser. No. 701,486, May 16, 1991, Pat. No. 5,178,067.

[51] Int. Cl.[6] ..... B41F 13/10

[52] U.S. Cl. ..... 101/375; 101/368

[58] Field of Search ..... 101/375, 368; 446/397, 446/411, 409, 402

[56] References Cited

U.S. PATENT DOCUMENTS

| | | | |
|---|---|---|---|
| 1,551,260 | 8/1925 | Michaels | 101/368 |
| 1,555,585 | 9/1925 | Kings et al. | 101/375 |
| 3,577,918 | 5/1971 | Wayfield | 101/375 |
| 4,593,618 | 6/1986 | Lebensfeld | 101/375 |
| 4,813,907 | 3/1989 | Rissman et al. | 446/409 |
| 4,936,780 | 6/1990 | Cogliano | 446/397 |
| 5,049,107 | 9/1991 | De Nittis | 446/397 |

*Primary Examiner*—Edgar S. Burr
*Assistant Examiner*—Anthony H. Nguyen

[57] ABSTRACT

A rotatable rubber stamp device is disclosed which produces a special effect when the stamp is pressed against and/or rolled across a medium to be imprinted therewith. The special effects generated by the stamp can include audible (speech, sound and/or music), visual (light patterns and/or sequences, and displays). A cavity in the plastic handle of the housing of the stamp device contains the electronic circuitry necessary to provide the special effects messages. A sensor, such as a spring-metal, lever-action switch, is affixed within a support bracket for a translatable axle of the rotatable stamp device mount, so as to trigger the electronic circuitry to issue the special effects message in response to the imprinting of a visual image from the rubber stamp upon the desired medium.

13 Claims, 16 Drawing Sheets

FIG 6A(1)
BOAR
640
600
690
650
660
680
FIG 6A(2)
HISS!
640
670
625
605
620
610
630
660
650
FIG 6A(3)
TRUMPET
640
650
660
FIG 6B(1)
605
700
730
711
710
630
FIG 6B(2)
750
FIG 6B(3)
FIG 6B(4)
FIG 6B(5)
FIG 6C(1)
TYP.
+5V
0V
FIG 6C(2)
FIG 6C(3)

CLOSED
OPEN
750
725
730
711
605
720
710
610
630
700
TYPICAL SWITCH SIGNAL : (ONE REVOLUTION)
OPEN
CLOSED
5V
0V

OFF
ON
800-1
800-2
800-3
(1)
(2)
(3)

MESSAGE CIRCUIT
800
940-1
940-2
940-3
940-C
800-1
800-2
800-3
800-C

SPECIAL EFFECTS ROTATING RUBBER STAMP

1. The present application is a continuation-in-part of a U.S. patent, Ser. No. 07/701,486, filed May 16, 1991, now U.S. Pat. No. 5,178,067.

BACKGROUND OF THE INVENTION

2. Field of the Invention

The present invention relates to rubber stamps and, more particularly, to rubber stamps with imprintable stamp element or elements affixed to a rotatable stamp element mount and capable of producing special effects such as those producing sound and light.

3. Statement of the Problem

Rotatable cylindrical mount, continuous element rubber stamps have been conventionally used for a long period of time to transfer an ink message onto paper sheets. Usually referred to in the market as "roller stamps" a wide variety of these stamps are available which transfer ink images of animals, greetings, designs suitable for creating printed boarders, or images of other types of objects. Other continuous element rotatable stamps have existed in the market for a long time, one type are commonly known as band stamps or rotary stamps, such as, for example, date stamps and business stamps, i.e. "RECEIVED"- - - "PAID"- - - etc. A related type of rotating stamp is the multiple element rubber stamp, in which, typically three to six separate, substantially flat stamp elements similar to those of the traditional single element hand stamp, are affixed in different locations upon a multiply faceted mount and the mount is rotated to select the specific image to be imprinted.

Most rolling rubber stamps are fabricated of plastic and consist of a housing and a round cylindrical, rotatable, stamp element mount with shaft, or axle extentions from opposite sides of the centers of its circular ends. The mount is a rigid substrate upon which an image carrying material, the stamp element or die, is firmly mounted. The housing is typically formed to have a handle and a bifurcated mount support bracket between the formed branches, or forks, of which the cylindrical stamp mount is rotatably mounted. The cylindrical mount is rotatably attached to the forks, i.e. branches, of the support bracket via the axles which extend through appropriately sized aperatures in the forks. Some rolling stamps; however, consist of only a cylindrical mount, a stamp element and axle extensions, and the user must hold the axle extensions in hand to imprint the stamp's images. The rubber stamp image is usually molded into a flat, rectangular strip of semi-porous rubber to become the stamp element, or die, which is then affixed with an adhesive "longwise" around the arcuate surface of cylinder's circumferance with opposite ends meeting to form a continuous stamp element.

Assembling the element onto the cylindrical mount is tedious and time consuming by comparison to the effort to affix an element onto the typically flat mount surface of the traditional hand stamp housing.

The cylindrical stamp element mount is typically 2 to 3 inches in diameter with a mounting surface typically between $\frac{1}{4}$ to $\frac{1}{2}$ inch wide, thereby, requiring the stamp element to be long and narrow, i.e. ($6\frac{1}{4}$–$9\frac{1}{3}$ inches long), by comparison to the traditional hand stamp which is typically much closer to a square shaped mount surface, for example, $1\frac{1}{2}$ by $2\frac{1}{2}$ inches. The long, narrow format and the continuous nature of the imprinting effects the implementations of image designs.

Rather than a single main image object, as typically seen in a traditional hand stamp, rolling stamp designs tend to have a plurality of images of several sizes, distributed "along" the element and image designs so as to give the appearence of movement. Since the physical ends of the rubber material of the element meet to form a virtually continuous substrate, the images thereon are normally designed to present as a continuous visual imprint. Furthermore, rolling stamp image design topics often explore moving or changing objects, for example, three humpback whales mixed in with four or five dolphins and several sea turtles, all swimming within a field of bubbles. Rolling stamps are also characterised by having a playful motion in their use. In use, the rolling stamp is typically rolled against an inkpad and then rolled against a medium to create an imprinted image. Some rolling stamps employ self-inking mechanisms within the housing. Rolling rubber stamps are normally sold at retail stores which also sell the more conventional hand rubber stamps.

Revolving band type stamps are physically characterised by having stamp elements which are formed as flat, continuous rubber bands with images molded thereon. The bands are usually mildly elastic and are typically extended to draw closely around, i.e. mount around, two parallel alligned cylindrical mounts and be movable thereon for selecting the imprintable message, i.e. "PAID". The cylindrical mounts are attached within a bracket and so as to be disposed above and beneath, the lower mount functioning as firm backing support for the element during imprinting. Often several individually movable bands are mounted adjacent and in parallel in order to individually select an image from each band element to form one "assembled" final image, i.e. such as a date: 7 29 92, wherein the numbers representing the days, months and years move seperately on seperate band stamp elements. In the band stamp the mount remains fixed and the element moves.

The multiple element stamp typically has a single mount, sometimes assembled from smaller parts, which is provided with a plurality of flat, rectangular stamp element mounting surfaces, i.e. a single stamp mount mechanism is formed to have plurality of element mounting surfaces disposed at different locations on the surface thereof to accomodate a plurality of stamp elements thereon. A rubber stamp is thereby created which has a plurality of selectable, imprintable image "facets". In one implementation of the multiple element stamp, the mount is a cubical shaped block with axle shafts extending from the centers of two opposing parallel sides of the cube. The stamp is also provided with four imprintable stamp images on the remaining four sides. The mount is assembled to a forked bracket of a handle mechanism to form a rotatable multiple element stamp in which the desired image is rotated to the position facing away from the handle, i.e. downward, to be selected for imprinting. In the resulting mechanism the mount is rotated to allow a desired image to be positioned for imprinting. As in the case of the rolling stamp, versions of the multiple image stamp are known in which the multiple image mount is provided without an attached handle, i.e. the user merely holds the mount, usually at locations provided thereon, in the appropriate position for inking and imprinting the desired image therefrom.

A movable element, or elements, and a plurality of images, continuously imprinted, or individually selectable for imprinting from a single stamp device, are characteristic aspects of rotatable mount stamps, i.e. rolling, rotating and revolving, etc., stamps.

There is a large and rapidly growing market for all types of rubber stamps, including rolling stamps and multiple element stamps. To a large extent, rolling rubber stamps and multiple image stamps are purchased for entertainment value or as a toy and novelty item.

A need exists to provide special effects to the conventional rotatable mount rubber stamp, i.e. the rolling cylinderical mount and the rotatable, multiple element stamp, that enhances the entertainment, toy, or novelty value of conventional versions thereof. Such special effects would include, for example, audible messages such as sound or music, visual messages such as different colored lights or sequences of light patterns or a combination of sound and light.

A need also exists for a special effects rotatable mount rubber stamp, i.e. the rolling cylinderical mount and the rotatable, multiple element stamp, that enhances the image creation characteristics of such stamps in combination with special effects.

Furthermore, a need exists for a rolling rubber stamp with special effects and a multiple image rubber stamp with special effects that can be easily manufactured on a mass production basis.

4. Solution to the Problem

The present invention provides a solution to the above problem by providing a cavity in a plastic handle of a formed housing of the rotatable mount rubber stamp so as to contain electronic circuitry necessary to provide the special effects messages. The formed housing is further comprised of a bifurcated support bracket, or fork, which is formed to accommodate the placement between the branches thereof of a rotatable stamp mount. The branches, i.e. forks, are each further formed to have an elongated axle aperature, the pair of axle aperatures being aligned and disposed to accommodate the axle of a rotatable stamp mount and to allow for the rotation and translation thereof. A sensor is affixed upon one branch of the bifurcated support bracket extension of the housing of the rubber stamp device so as to be actuated upon the translation of a rotatable stamp mount mounted therein. A rotatable, continuous element stamp mount is rotatably and translatably attached between the branches of the fork, via the axle extensions which extend through the elongated apertures of the support branches. The elongated apertures allow for both rotation and translation of the axle and mount mechanism. The sensor mechanism is comprised of, for example, a spring-metal, lever action switch, so as to trigger the electronic circuitry to issue the special effects message in response to the imprinting of the visual image from the rotatable, mount rubber stamp upon the desired medium. Other switch mechanisms are readily adapted for message generation from a multiple element mount rubber stamp, as will be discussed elsewhere herein.

The present invention provides a variety of special effects including audible (speech, sound effects and/or music) and visual (light patterns and/or sequences, visual display). The message generating electronics of the present invention are contained within a cavity of the plastic handle so as not to interfere with the conventional operation or visual appearance of the conventional rotatable, cylindrical mount rubber stamp.

Finally, the present invention can be quickly and easily assembled via mass production and is capable of being easily modified for different special effects.

SUMMARY OF THE INVENTION

The rotatable mount, continuous-element, rubber stamp of the present invention produces a special effect when the stamp is pressed against and/or rolled over a medium to be imprinted therewith. The special effects generated by the stamp can include audible (speech, sound effects and/or music) and visual (light patterns and/or sequences, graphic display). A cavity in the plastic handle of the housing of the rotatable mount rubber stamp device contains the electronic circuitry necessary to provide the special effects messages. A sensor, such as a spring-metal, lever-action switch, is affixed upon a branch of a bifurcated support bracket of the rubber stamp device. Additionally, a rotatable mount mechanism of the rubber stamp device is translatably and rotatably mounted, via axle extensions thereon, extending through alligned, elongated apertures in the parallel, opposing branches of the bifurcated support bracket, so as, in active contact with the lever-switch mechanism, to trigger the electronic circuitry to issue the special effects message in response to the imprinting of a visual image from the rubber stamp upon the desired medium. Switch mechanisms and methods are disclosed, which are employed with the cylindrical mount, continuous element stamp device or with the multiple element rotatable mount stamp device, to allow coordination of playout of a plurality of effects messages with the imprinting of a plurality of respective stamp images of the stamp element, or elements, upon a medium. Methods are disclosed in the invention to modulate the rate of message playout with rotation the speed of the rotatable cylindrical stamp during imprinting.

BRIEF DESCRIPTION OF THE DRAWING

FIG. 6A(1) shows an image of a lion being imprinted with the coordinated generation of a "roar" sound;

FIG. 6A(2) shows an image of a snake being imprinted with the coordinated generation of a "hiss" sound;

FIG. 6A(3) shows an image of an elephant being imprinted with the coordinated generation of a "trumpet" sound;

FIG. 6B(1) shows the activation switch of the second alternative embodiment being actuated by the cam mechanism, coordinating the generation of sound effects with the image imprinted in FIG. 6A(1);

FIG. 6B(2) shows the activation switch of the second alternative embodiment being actuated by the cam mechanism, coordinating the generation of sound effects with the image imprinted in FIG. 6A(2);

FIG. 6B(3) shows the activation switch of the second alternative embodiment being actuated by the cam mechanism, coordinating the generation of sound effects with the image imprinted in FIG. 6A(3);

FIG. 6B(4) shows the activation switch of the second alternative embodiment being in the open position coincident with the low portion of the cam mechanism adjacent thereto;

FIG. 6B(5) shows the activation switch of the second alternative embodiment being in the open position coincident with the low portion of the cam mechanism adjacent thereto;

FIGS. 6C depict respective voltage signals on lines connected to the cam-driven activation switch of the second alternative embodiment, during actuation thereof, as the device is imprinted in FIGS. 6A;

FIG. 6C(1) depicts respective voltage signal on lines connected to the cam-driven activation switch of the second alternative embodiment, during actuation thereof, as the devices is imprinted in FIG. 6A(1);

FIG. 6C(2) depicts respective voltage signal on lines connected to the cam-driven activation switch of the second alternative embodiment, during actuation thereof, as the devices is imprinted in FIG. 6A(2);

FIGS. 6C(3) depicts respective voltage signal on lines connected to the cam-driven activation switch of the second alternative embodiment, during actuation thereof, as the devices is imprinted in FIG. 6A(3);

FIGS. 9A are diagrams of a rotary switch mechanism, depicting a plurality of switch positions, which may be alternatively utilized in the continuous image rotating stamp to activate the message circuit to generate a plurality of respective effects messages, or be utilized in the multiple image stamp to select for activation from a plurality respective effects message;

FIG. 10 (*b*) shows the rotatable mount, multiple element rubber stamp device and an imprinted image produced by the operation of the device;

FIG. 10 (*c*) shows rotation of the mount mechanism to select an image, from a set of imprintable images, to be imprinted from the rotatable mount, multiple element rubber stamp device of the invention;

FIG. 10 (*d*) is an illustration of the rotatable mount, multiple element rubber stamp device of the present invention in operation, showing an audible message being generated in response to the imprinting of an image contained on the rubber stamp;

FIG. 10 (*e*) shows the rotatable mount, multiple element rubber stamp device and an imprinted image produced by the operation of the device;

FIGS. 11A are diagrams showing an activation/selection switch mechanism of the preferred embodiment of the rotating mount, multiple element stamp of the invention, and further showing four example special effects selection positions of the "open" or non-imprinting state;

FIGS. 11B are diagrams showing an activation/selection switch mechanism of the preferred embodiment of the rotating mount, multiple element stamp of the invention, and further showing four example activation selection positions of the "closed" or stamp imprinting state, respective to the "open" states of FIGS. 11A;

FIG. 12(*b*) is a cross-section diagram showing a locked-in imprinting position and an engaged "closed" activation switch position of the rotating mount, multiple element stamp of the invention;

FIG. 12(*c*) is a cross-section diagram depicting the unlocking of the imprinting position and the rotating of the stamp mount to select a desired printing position of the rotating mount, multiple element stamp of the invention;

FIG. 12(*d*) is a cut-away perspective diagram, with the translation-reversing spring removed, showing the axle and stamp mount mechanisms fitting into the elongated axle slot of the mount bracket of the rotating mount, multiple element stamp of the invention;

DETAILED SPECIFICATION

Figure 1:
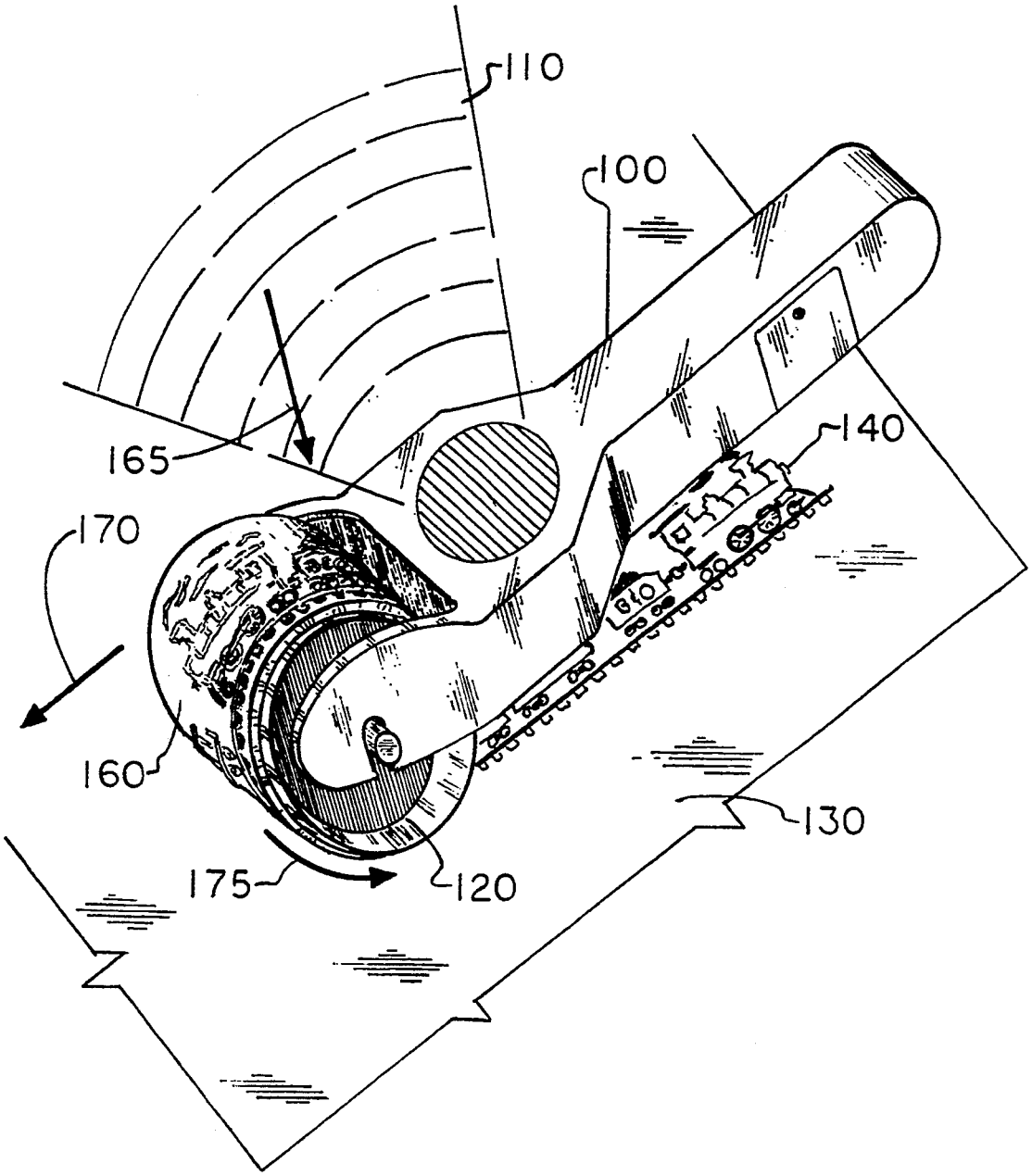
FIG. 1 is an illustration of the rotatable cylindrical mount rubber stamp device of the present invention in operation, showing an audible message being generated in response to imprinting of a image contained on the rubber stamp, and an imprinted image produced by the operation of the stamp.

FIG. 1 illustrates the operation of the rotatable, cylindrical mount, continuous-element rubber stamp device 100 of the present invention, showing a special effects sound message 110 being generated when the mount 120 carrying an image 160 of the rubber stamp device 100 is pressed 165 against and rolled 175 over a medium, such as paper, to be imprinted 130. FIG. 1 further shows an example resulting in an imprinted visual image 140 on the medium 130. In the example of FIG. 1, the sounds 110 of a train, "Woo—Woo, "Choo—Choo—-Choo" and "Ding—Ding—Ding" are produced in response to imprinting. The sounds 110 relate to the image 140. Other audible examples could be: pigs—"oinking," or a sequence of sounds representing several farm animals: "MOO," "Oink," "Baa," and so forth, or the sounds of whales and dolphins, the sounds of vehicles, the sounds of planes, the sounds of instruments playing, or a message such as "I love you", each generated in response to imprinting a related image. Images could be, for example, animals, vehicles, or a heart with the words "I LOVE YOU." The message could also be lights or a visual display or a combination thereof.

FIGS. 10 (*a*) through 10 (*e*) illustrate the operation of the rotatable mount, multiple element rubber stamp device 1000 of the present invention, showing special effects sound message 1010 being generated when the rubber stamp device 1000 is pressed 1020 against a medium 1030, such as paper, to be imprinted 1060 therewith. FIG. 10 (*c*) further shows the selection of different images of the stamp device 1000. In the examples of FIGS. 10 (*a*) and 10 (*b*), the sound 1010 of a frog, "Grubbit Grubbit" is produced in response to imprinting the image 1060 of a frog upon a medium 1030. The printed visual image 1060 is revealed when the device 1000 is lifted 1022 from the surface of the medium 1060. FIG. 10 (*c*) illustrates a stamp element 1040 containing the image of a pig being selected (1080 and 1045) for imprinting. In the examples of FIGS. 10 (*d*) and 10 (*e*), the sound 1010 of a pig, "Oink Oink" is produced in response to imprinting the image 1060 of a pig on the medium 1030. The sounds relate to the images. Other audible examples could be: pigs—"oinking," or a sequence of sounds representing several farm animals: "Moo, " "Oink", "Baa," and so forth, or the sounds of whales and dolphins, the sounds of Vehicles, the sounds of planes, the sounds of instruments playing, or a message such as "I love you", each generated in response to imprinting a related image. Images could be, for example, animals, vehicles, or a heart with the words "I LOVE YOU."

Another example based upon FIGS. 10 (*a* . . . *e*), is a logical sequence of images and related effects messages, such as, a multiple element stamp with four seperate images in a baseball playing scenario consisting of: (1) a batter swinging, (2) a batter hitting a ball, (3) a fielder catching a ball, and (4) a runner sliding into home base. The respective audio messages played in response to imprinting these images could be: (1) a "swish" sound followed by a spoken "Strike One!", (2) a "crack" sound followed by a spoken "It's a hit!", (3) a spoken "Nice catch!", (4) a spoken "Safe!" The message could also be lights or a visual display.

1. Operation of the Rubber Stamp Device

FIG. 1 is an illustration of the rotatable, cylindrical mount, continuous element rubber stamp device 100 in operation. In order to operate the rubber stamp device 100, the rubber stamp element 160 is typically pressed against and rolled over an ink pad (not shown) and then pressed in direction 165 and rolled in direction 170 against the medium 130 to which the visual image 140 is to be transferred, as cylindrical mount 120 rotates in direction 175. Alternatively, the stamp element 160 can be self-inking, in which case, an ink pad is not required. It is to be expressly understood, however, that the method chosen for applying ink to the stamp element is not a pertinent feature of the present invention. When the rubber stamp element 160 is pressed against and rolled over the medium 130, an ink image is transferred to the medium 130, and the special effect message 110 is generated. The cylindrical mount, continuous element rotating stamp of the present invention is capable of providing a variety of special effects 110 including audible effects (speech, sound effects and/or music) and visual (light patterns and/or sequences, visual display), although typically only one effect, or sequence of effects, is produced by a given stamp device.

FIGS. 10 (*a* . . . *e*) are illustrations of the rotatable mount, multiple element rubber stamp device 1000 in use. The figures show the formed housing 1005, speaker compartment 1035 and stamp mount bracket 1090 of the formed housing, the rotating, multiple element mount mechanism 1025, the reversably locking, translatable axle 1015 and stamp element 1040 of the stamp device. In order to operate the rubber stamp device 1000, the user typically selects the desired image to imprint by pushing the mounting bracket 1090 of the stamp device 1000 in the 1080 direction to "unlock" the translatable/-locking axle 1015 and rotating 1045 the stamp mount 1025 until the desired image faces "downward". When the bracket 1090 is released the mount axle 1015 and attached multiple element stamp mount 1025 are locked into positon 1085 for imprinting while allowing translation for actuation of the FIGS. 11A & B activation switch. The rubber stamp is typically pressed against an ink pad (not shown) and then pressed in direction 1020 against the medium 1030 to which a visual image 1060 is to be transferred. Alternatively, the stamp element 1040 can be self-inking, in which case, an ink pad is not required. It is to be expressly understood, however, that the method chosen for applying ink to the stamp element is not a pertinent feature of the present invention. When the rubber stamp element 1040 is pressed against the medium 1030, an ink image 1060 is transferred to the medium 1030, and the special effect message 1010 is generated. The rotating mount, multiple element rotating stamp of the present invention is capable of providing a variety of special effects 1010 including audible effects (speech, sound effects and/or music) and visual (light patterns and/or sequences, visual display), although typically only one effect, or sequence of effects, is produced by a given stamp device.

2. Switch Mechanism of the Rubber Stamp Device

Figure 2:
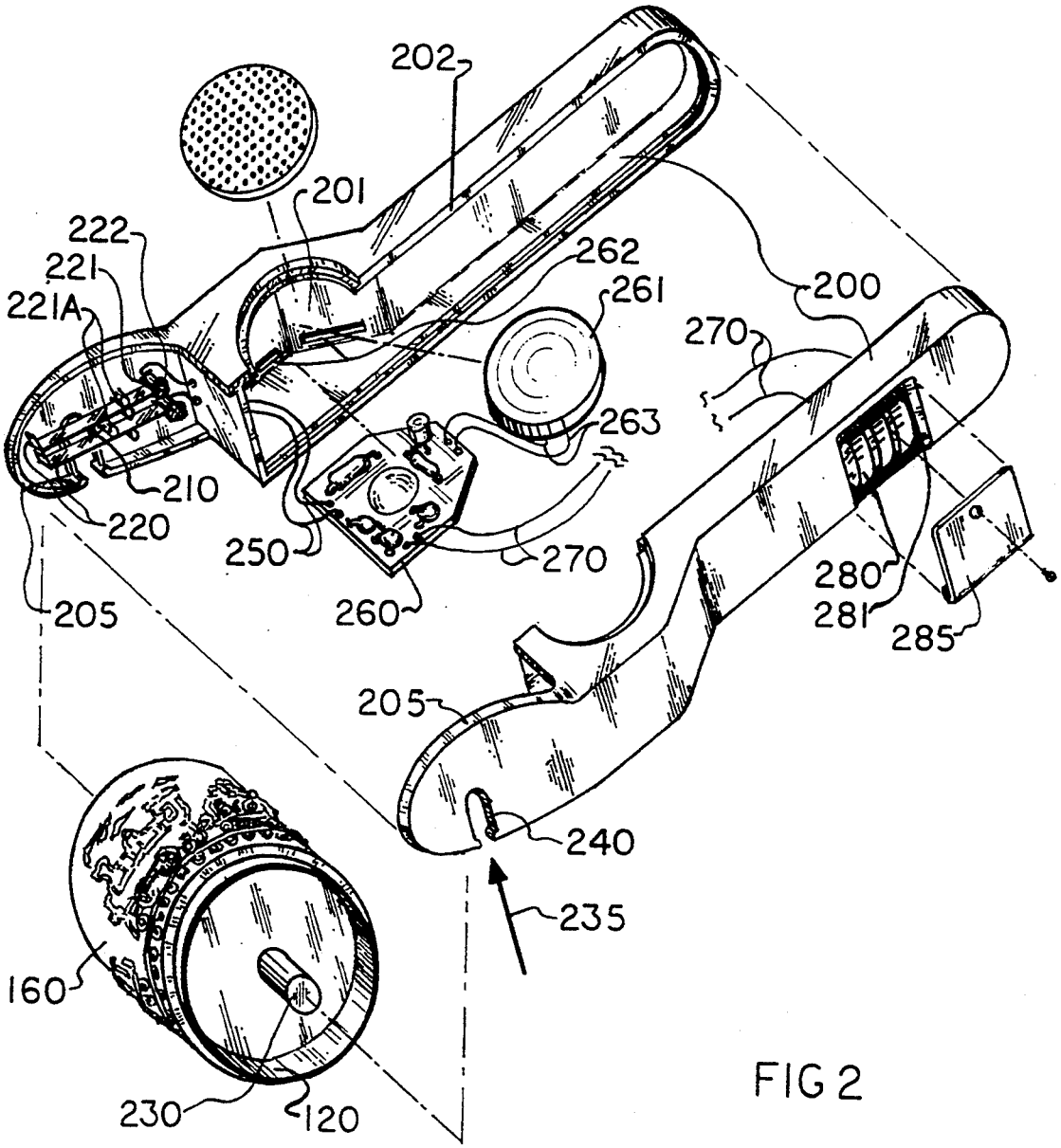
FIG. 2 is an exploded perspective view of the rotatable cylindrical mount rubber stamp device, showing components.

FIG. 2 is an exploded perspective view of the rotating mount, continuous element stamp device of the invention. The special effect message 110 is typically produced in response to the creation of the image 140, as shown in FIG. 1. For example, the message 110 could be produced in response to a predetermined amount of force that is applied to a metal switch lever 210 of a momentary-contact, spring-metal, lever-action switch 220 as a result of an axle 230 of a rotatable, cylindrical mount 120, being translated in direction 235 with respect to the fork 205, within an elongated axle aperature 240, as rubber stamp element 160 is pressed against the medium 130 with a predetermined amount of force.

Figure 3:
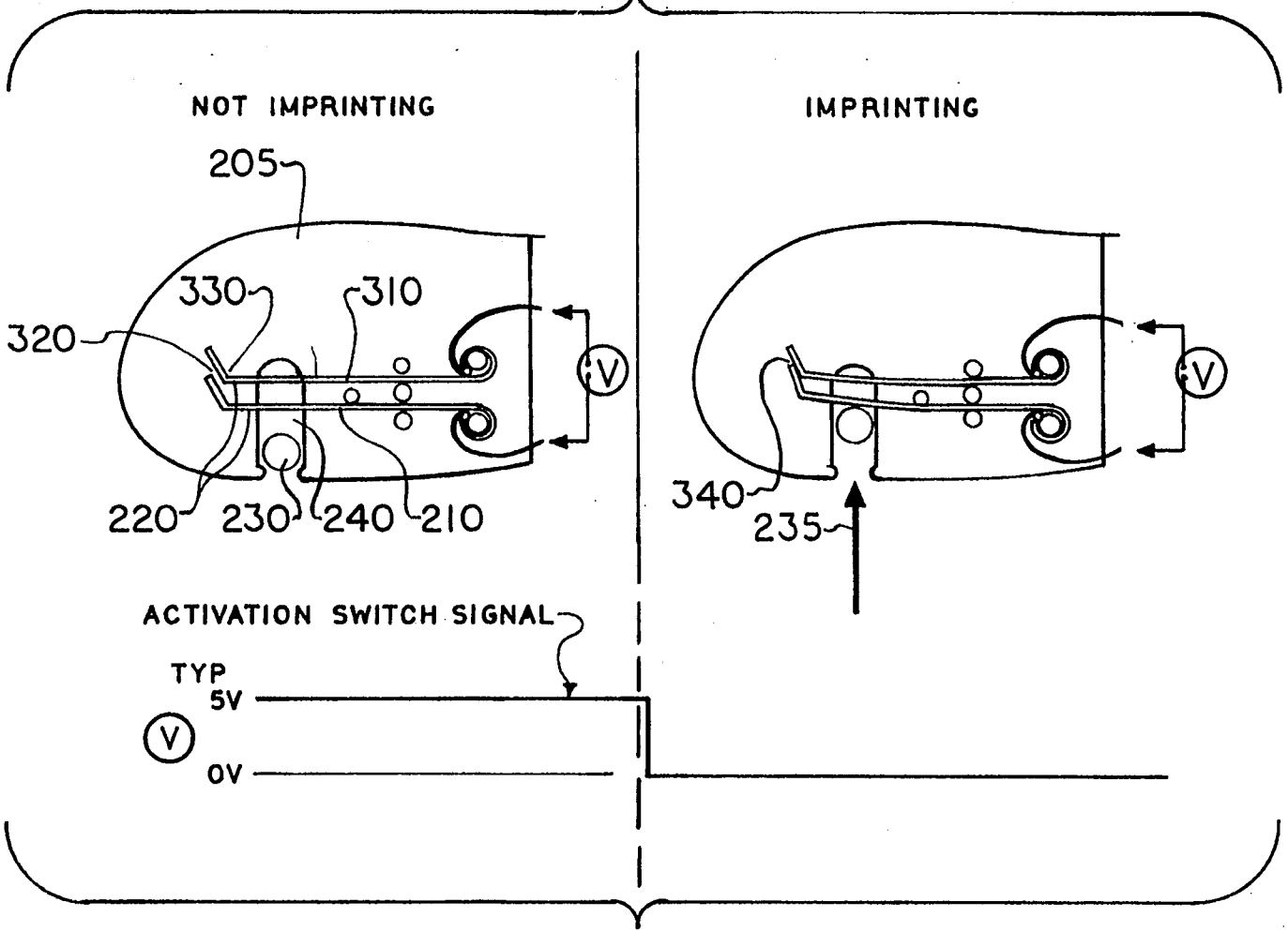
FIG. 3 is a diagram showing the placement of internal switch components of the rotatable cylindrical mount rubber stamp device and demonstrating the operation of the switch in conjunction with the translatable axle of the invention.

In the preferred embodiment, as shown in FIG. 2, a lever-action switch 220 (shown in detail in FIG. 3) consists of, for example, an essentially fixed contact element 310 and a bridge contact element 210 normally separated by a non-conductive gap 320. The fixed contact element 310 typically is an electrically-conductive, elastic metal strip affixed to the interior of the stamp mount support fork 205 of the stamp device 100 and disposed essentially parallel and adjacent to the bridge contact element 210, also mounted therein. The bridge contact element 210 is an electrically-conductive, elastic metal lever, firmly mounted at one end to the stamp mount support fork 205 and reversibly displacable at the other end, which, when pressed against the adjacent fixed contact element 310, causes the switch 220 to "close," i.e. , current is allowed to flow between the two contact elements of the switch 220. Portions of the bridge contact element and fixed contact element may be formed 330 so as to improve electrical contact at the locations of physical contact 340 when the switch is actuated. The elasticity of the bridge element causes the switch to remain normally in the "open" position when the stamp device 100 is not in operation, thereby maintaining the non-conductive, inter-contact gap 320 whenever a switch-closing force 165 is absent. However, when force in direction 165 is applied to the stamp device 100 and fork bracket 205, thereby deflecting the free end of the bridge contact element 210, such as when the rubber stamp element 160 of the cylindrical stamp mount mechanism 120 is pressed against a meduim 130, the momentary contact switch 220 is actuated. The fork aperature 240 moves "downward" in direction 165 over the translatable axle, or shaft, 230 thereby pressing the attached bridge contact element 210 against the axle 230 causing the bridge contact 210 to deflect in direction 235 and make electrical contact 340 with the fixed contact element 310, thus "closing" the switch 220 and activating the electronics of the message circuit 400. The elasticity of the bridge contact element, and gap width between the contact elements may be preselected, for example, in order to ensure the desired predetermined actuation pressure. A "balancing" spring lever, ie. on the non-switch axle extension, may be necessary, to avoid twisting of the cylindrical mount mechanism in the fork aperatures as the switch is actuated. Such a balancing spring could be an elastic lever, with similar elasticity to the bridge contact switch lever, mounted within the fork opposite that in which the switch is mounted.

While a preferred embodiment for a spring metal, lever-actuated switch is shown, it is to be expressly understood that any of a number of different switch designs could be utilized to activate the message circuit under the teachings of the present invention. A snap-action roller-lever switch could be used. Or, for example, an accelerometer could be used to sense the force of motion of the stamp housing 200 of the rubber stamp 100, or to sense the rotational acceleration from within the cylindrical stamp mount 120. A mercury type switch, could be disposed to actuate upon a predetermined tilt angle of the housing 200 of the rubber stamp 100 to activate the electronics of the message circuit. A motion or acceleration switch, and the message generation circuitry, and the battery, and speaker mechanisms could all be disposed within a formed interior of the cylindrical stamp mount 120, and activated by the rotation thereof. Another switch actuating approach which could be employed in the invention involves forming the housing 200 and fork branches 205 as seperately moving, hinged components in a manner to allow the fork branches to reversibly move, or to telescope upward into the attached formed housing, upon contact of the stamp with the medium. A switch similar to the lever switch discussed above, is mounted within the housing and is actuated by contact with an element of the fork mechanism as it telescopes into the housing or moves about a hinge.

Another switch which could be employed under the teachings of the invention is a flexible, momentary-contact, thin-film, pressure-sensitive switch, which could be disposed upon the arcuate curve of the circumference of the cylindrical stamp mount between the mount surface and the stamp element mounted thereon. Contacts from the switch are extended through the surface of the mount to a formed interior thereof. The operative connection of such a switch could be achieved by employing an axle assembled as three segments, two electrically conducting segments seperated by a short non-conductive segment. Interior and exterior extensions of each conductive axle segement are continuously contacted by "brushing" flex metal stator contacts, the interior stators being connected to the switch contacts and the exterior stators to the message circuit.

Additionally, a switch could be employed which is comprised of a non-conductive, disk-shaped medium having a conductive strip bridge element affixed on its surface. The disk is then mounted to be concentric and co-rotational with the rotatable stamp mount mechanism. Two seperate, flexible, conductive stator contacts then could be affixed upon a fork and disposed to "sweep" the surface of said disk object surface as it rotated with the stamp imprinting. The bridge element is disposed upon the disk in a manner to align with and electrically bridge the two stator contact elements at least once per revolution of said stamp mount.

A wide variety of switching mechanisms could be employed within the present invention to activate the message circuit and it is expected that those skilled in the art will explore and employ many variations thereof. This disclosure is demonstrative of a variety of implementations and is not intended to be an exhaustive discussion of switching techniques.

It is expressly understood that employing different activation switch mechanisms could effect the actual timing of the generation of the special effects message with respect to the imprinting of the image. The sound is typically in response to the imprinting; however, in some alternative techniques of message activation, the effects message might slightly precede the completed image transfer. Furthermore, since the image(s) is (are) effectively "continuous," other temporal correlation effects could occur. The main thrust of the above activation switching is to create a novel rotatable stamp experience through generating an effects message in a temporally proximate manner with transferring an image or images. In some instances sound generation might be purposefully delayed following switch activation. Furthermore, sound generation could be activated upon "deactuation" of an actuated switch. Such a timing relationship, for example, could be used to create an interesting effect in a continuous element rotating stamp which depicts an airplane dropping a bomb. In such a stamp device, an airplane diving sound and bomb "whistle" sound would occur as the stamp is imprinted, ie. switch actuated, and an explosion sound would occur as the stamp is lifted from the paper, i.e. switch is "de-activated."

The operation of the multiple element, rotating mount stamp device 1000 of the invention differs from that of the continuous element, rolling stamp device 100. In the multiple element device each image to be imprinted is discretely selected and discretely imprinted, whereas, in the rolling stamp device a single element is continuously imprinted.

In the operation of a special effects, rotatable mount, multiple element rubber stamp, of FIG. 10, the special effect message 1010 is typically produced in response to the creation of the image 1060. For example, the message 1010 could be produced in response to a predetermined amount of force in direction 1020 that translates the housing 1005 and its attached stator contacts 1101 in direction 1020 so as to slide the stator contacts over a selected bridge contact 1120 of the rotating-selection, sliding-action switch 1100 of FIGS. 11A & 11B thereby "closing" the selected activation switch. Note, in FIG. 10 (*a* . . . *e*), the selection/activation switch 1100 is on the end of the stamp device 1000 facing away from the perspective views shown. The elements of the switch 1100 are seen most clearly in FIGS. 11 and FIGS. 12.

The activation switch mechanism 1100 for the preferred embodiment of multiple element stamp device 1000 of the invention is diagrammed in FIGS. 11A (1 . . . 4), 11B(1 . . . 4) and 12(*a* . . . *d*). The switch 1100 consists of, for example, four translatable "stator" contacts 1101 and a rotatable bridge contact element 1115. The stator contacts 1101(*c*, 1, 2, 3) are typically conductive, elastic metal strips formed and mounted to housing 1005 in a manner to extend parallel "downward" beneath the housing 1005 and to reversibly translate therewith in relation to the stamp mount 1025. The elongated axle aperature 1095 of the fork 1090 allows the housing 1005 and attached "stator" contacts 1101 to move "downward" over the stamp mount 1025 and affixed bridge contact element 1115 during imprinting. The stator contacts 1101 are disposed so as to extend over and "brush" against the surface 1220, shown in FIGS. 12 (*a*) and (*b*), of the rotatable bridge contact element 1115 in a manner to allow combinations of said stator contacts to electrically engage (FIGS. 11B, 1130 and FIG. 12(*b*), 1230), i.e. be bridged by, and disengage (FIGS. 11A and FIG. 12(*a*), 1231) with selected conductive bridge contacts 1120 disposed thereon during said reversable translation. The examples of FIGS. 11A(1, 2, 3, and 4) show four disengaged, or "Switch Open" selection states of the activation switch 1100, and the examples of FIGS. 11B (1, 2, 3, and 4) show four respective engaged, or "Switch Closed" selection states of the activation switch. A plurality of bridge contacts 1120 are formed and disposed upon the bridge element 1115 so as to electrically engage, or connect, a distinct set of stator contacts 1101 corresponding to a selected imprintable image during imprinting of the stamp device. For example, in the illustration of FIGS. 11A(1) and 11B(1), a selection state is shown in which a respective, selected bridge contact 1121 causes an electrical connection 1130 between stator contacts 1101-C and 1101-3 when the stamp mount 1025 is translated with respect to the housing 1005 and attached stator contacts 1101 during imprinting of the stamp device. In like manners: FIGS. 11A(2) and 11B(2) show connection being made between stator contacts 1101-C and 1101-1; FIGS. 11A(3) and 11B(3) show connection being made between stator contacts 1101-C and 1101-2; FIGS. 11A(4) and 11B(4) show connection being made between stator contacts 1101-C, 1101-1, and 1101-2 when the stamp is imprinted. Four imprintable images of the stamp device correspond respectively to four unique combinations of electrically engagable stator contacts. The stator contacts (1101-1, 1101-2, 1101-3, and 1101-C) are further operatively connected to the message circuit 800 respectively via wires (800-1, 800-2, 800-3 and 800-C). The rotatable bridge contact element 1115 is formed from a flat, rigid, non-conductive substrate 1110 and a set of conductive bridge contacts 1120 disposed upon the the surface thereof. Typically the bridge contacts 1120 are conductive foil circuit "runs" which are "printed" upon an electronic circuit board substrate 1110 formed from phenolic material. The rotatable bridge contact element 1115, with a hole provided for the axle extension 1015, is firmly attached to the planar surface of the end 1210 of the stamp mount 1025 using an appropriate adhesive material so as to rotate therewith. Note in FIGS. 11 A & B the square, locking axle end, shown in FIG. 12(*a*), 1217, is not shown. Rather, for clairity, the circular shank portion 1216 of the axle 1015 is shown in cross section as it enters the mount 1025 surface. The circular hole 1116 shown in the non-conductive substrate 1110 of the bridge contact element 1115 is enlarged so as to fit "over" the square end of the axle 1015 during assembly. At each locked position 1085 of rotation of the mount 1025 there is a stamp element image 1040 selected to be imprinted, i.e. facing "downward" or away from the direction of the housing 1005, and an associated conductive bridge contact 1120 positioned so as to electrically bridge a respective combination of stator contacts 1101 upon imprinting said selected image upon a medium 1030. Note, in FIGS. 11 A & B the stamp elements are not shown: for clairity, only the mount 1025 and associated switch mechanism elements are shown. Upon the "closing" of the switch, as shown in the examples of FIGS. 11B "Switch Closed" i.e. electrically bridging 1130 respective combinations of stator contacts 1101 (1, 2, 3, *c*), a voltage change signal is established on one or more of said contacts, corresponding to said bridged combination, and on the corresponding operative connections thereof (800-1, 800-2, 800-3, 800-*c*). The message circuit 800 determines the message appropriate for the respective combination of bridged stator contacts and generates this message via the speaker therein.

Figure 8:
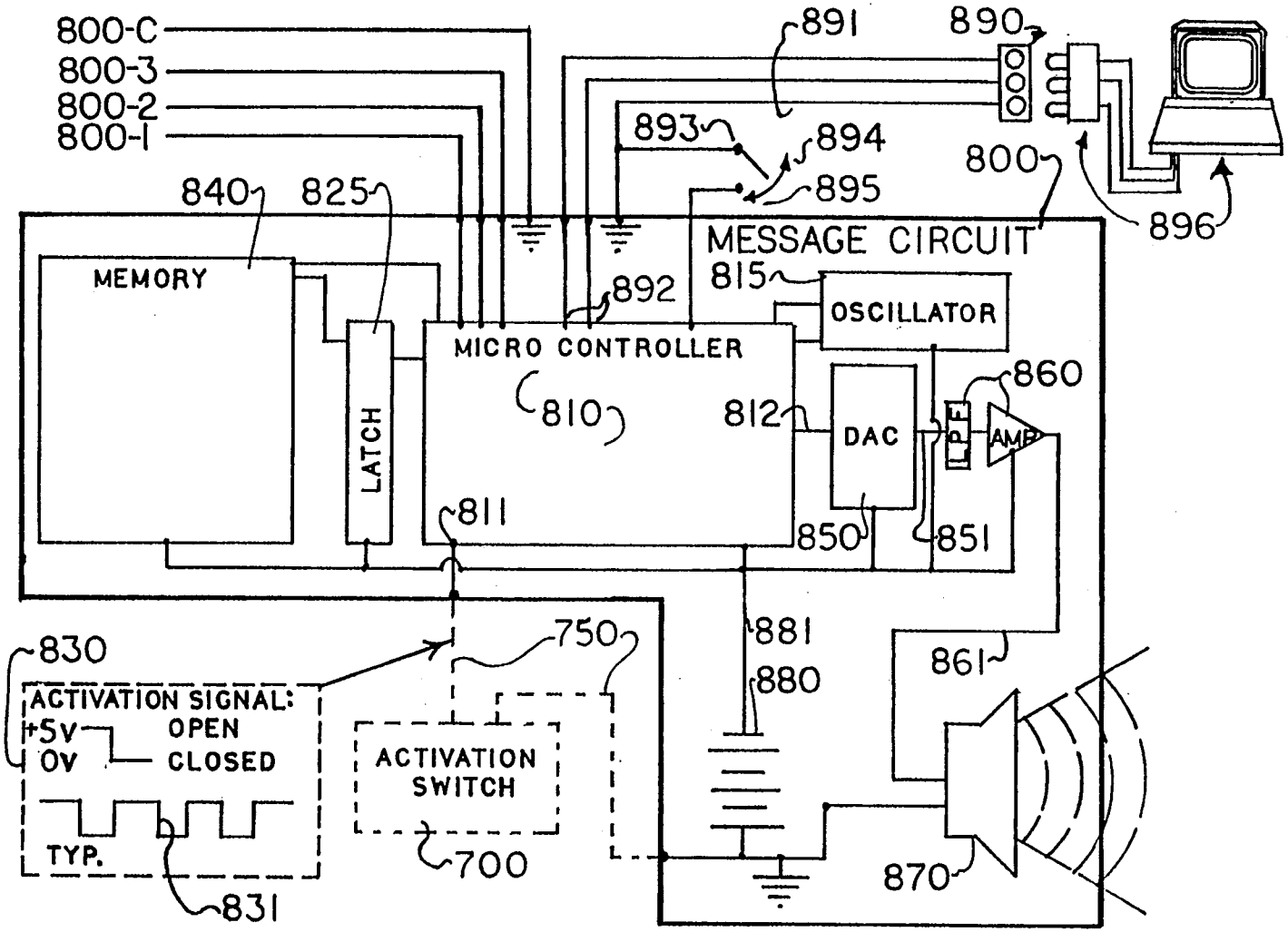
FIG. 8 is a diagram of the message circuit of the multiple element rotatable mount stamp of the present invention, also employed with the second alternative embodiment of the continuous element rolling stamp, used to generate audible special effect messages.
Figure 11C:
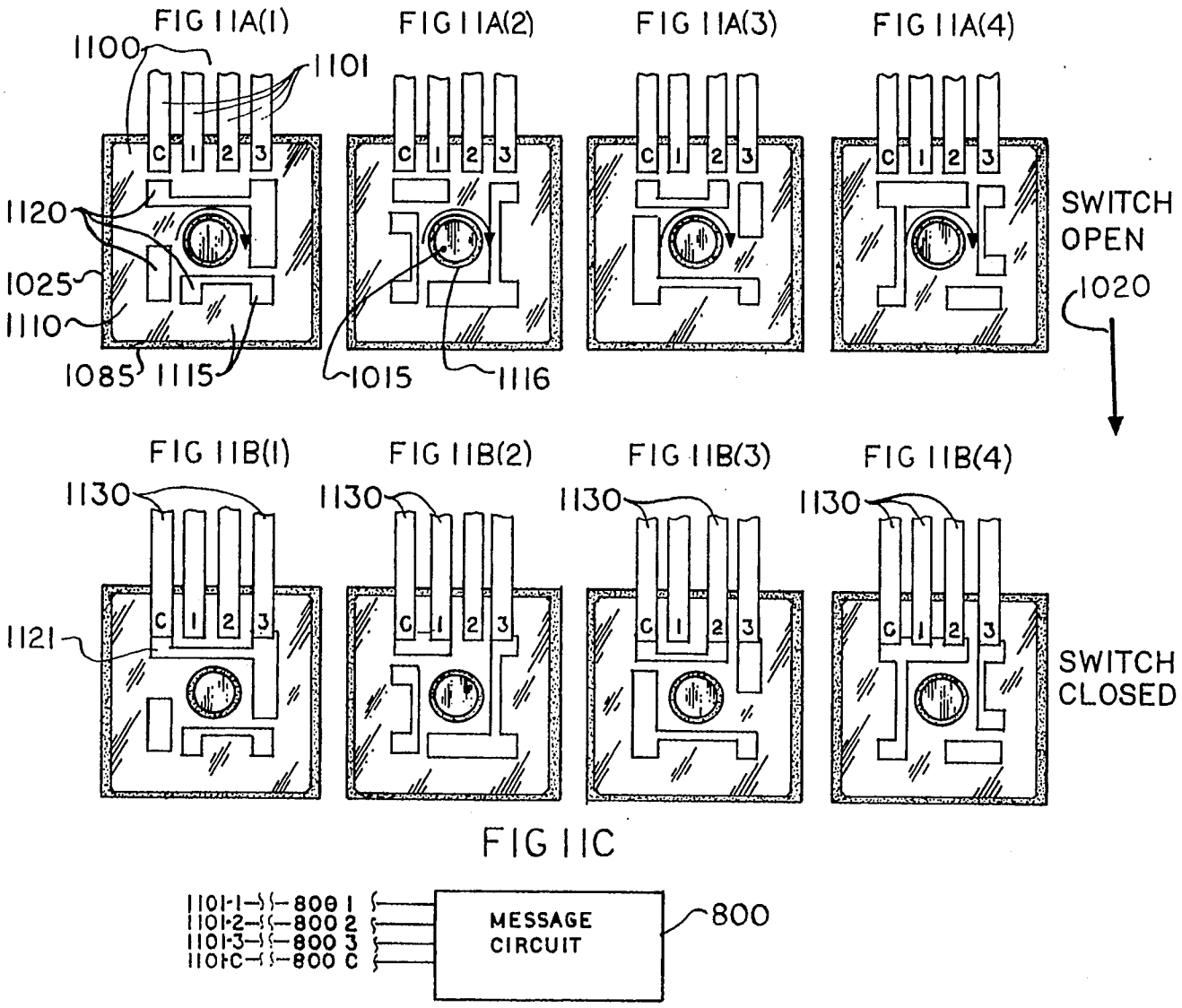
FIG. 11C is a block diagram of operative connections of the switch of FIGS. 11A & 11B to the FIG. 8 message circuit.
Figure 12B:
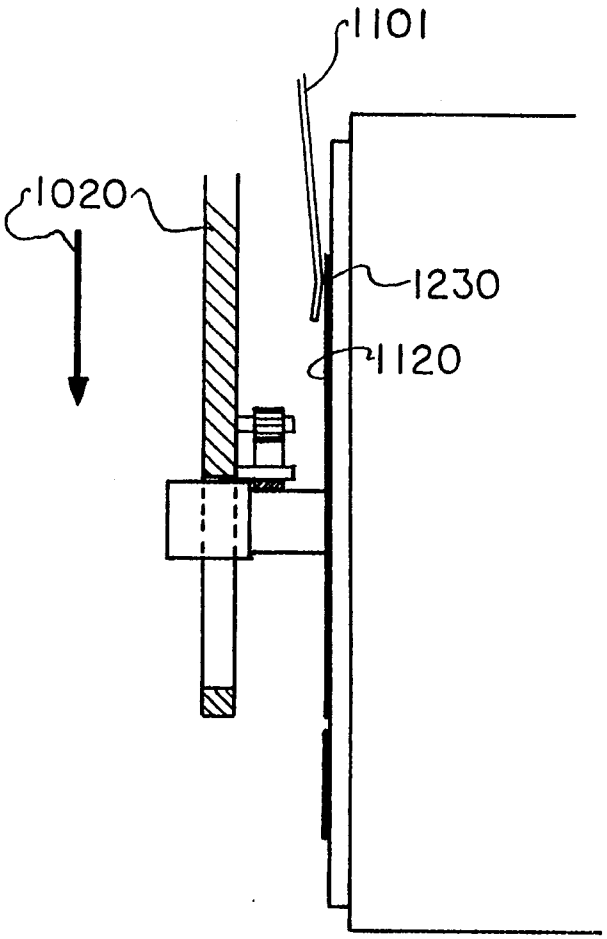
FIG. 12(*a*) is a cross-section diagram showing a locked-in stamp mount imprinting position and a disengaged "open" activation switch position of the rotating mount, multiple element stamp of the invention.
Figure 12A:
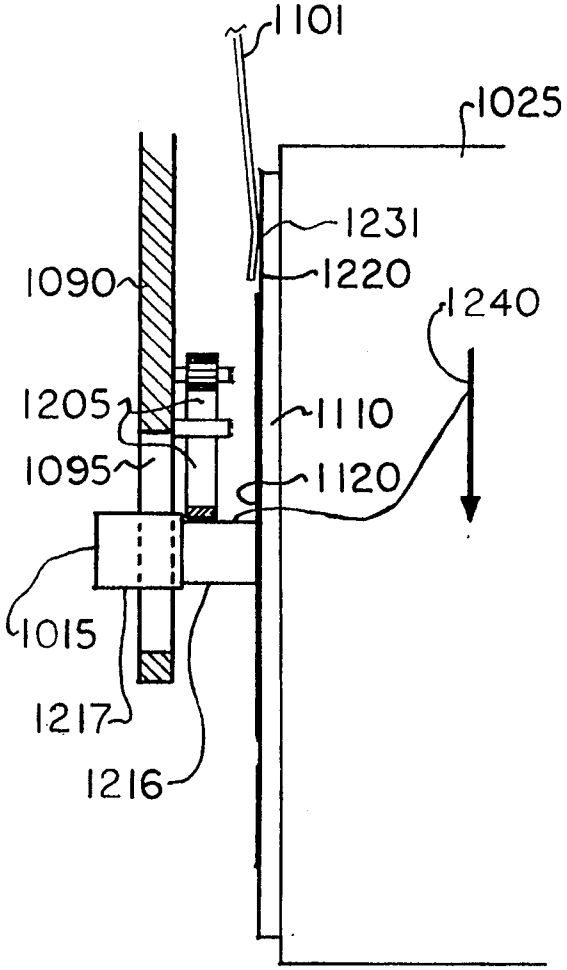
Figure 12D:
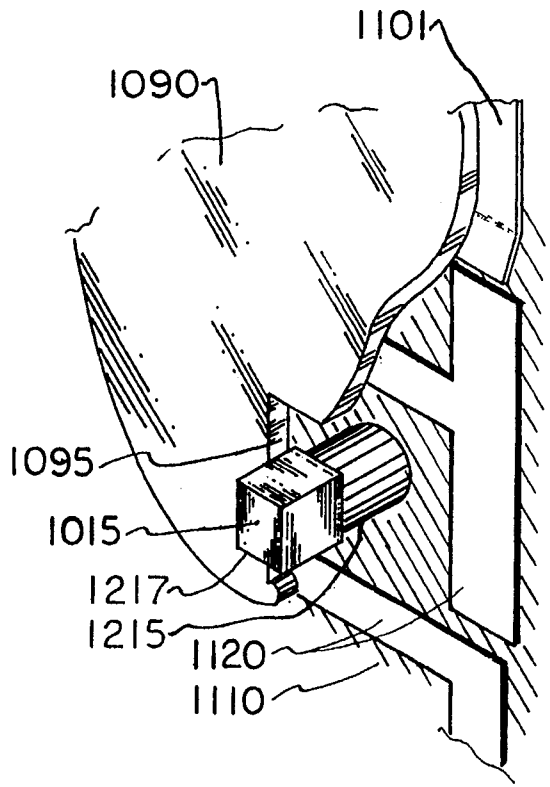
Figure 12C:
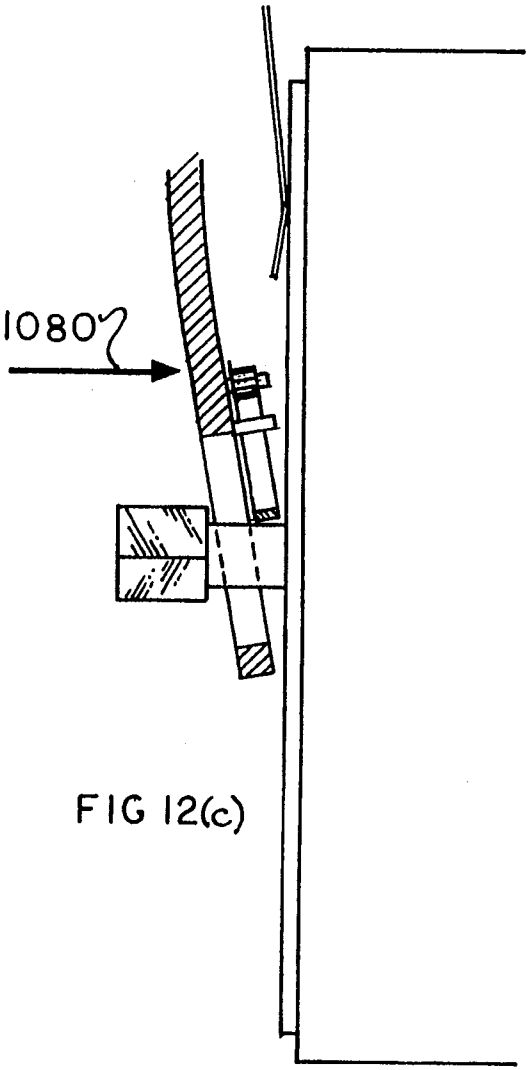

FIG. 11C shows block diagram alternative operative connections for the message circuit of FIG. 8 through which the switch of FIGS. 11A & B provides activation signals to message circuit 800. The alternative message circuit is comprised of the components of message circuit 800, including suggested alternative components, and conveniently employs additional input ports of the micro-controller 810 and modified software therein to process the activation switch signals presented on a plurality of operative input lines.

FIGS. 12(*a* . . *e*) depict cross-section and cut-away diagramatic views of the reversable lock for image selection and reversable mount translation for switch actuation operation of the rotatable mount, multiple image rubber stamp of the invention. FIG. 12(*a*) shows a stator contact 1101 pressing against the surface 1220 of the non-conductive portion of the bridge element in a manner NOT engaging 1231 bridge contact 1120. The figure further shows a spring metal mechanism 1205 applying pressure 1240 against the circular shank portion 1216 of axle 1015, thereby translating the axle 1015 and mount 1025 to disengage the activation switch, of FIGS. 11 A & B, when the stamp device is not being imprinted. FIG. 12(*b*) shows the stator contact 1101 engaging 1230 the bridge contact 1120 when the housing/bracket 1090 and attached stator contacts 1101 are translated in the direction 1020 during imprinting of the device. FIG. 12(*c*) shows the reversable distortion of bracket 1090 to unlock the mount axle 1015 allowing the mount 1025 to be rotated 1045 for image selection. FIG. 12(*d*) is a cut-away diagram of the bracket 1090, axle 1015, mount 1025 and activation switch contacts 1101/1120 provided to clairify the assembled mechanisms. The spring mechanism 1205 is not shown.

It is expressly understood that many alternative activation switching designs could be employed in the multiple element, rotatable mount stamp device of the present invention. The switching serves to coordinate the generation of a plurality of special effects messages in response to the imprinting of a plurality of respective visual images of the multiple element, rotating mount rubber stamp device of the invention. Such coordinated message generation can, for example, be achieved by employing a cam or rotary type switch mechanism for effects message selection, correlated with the mount position of the selected image, as discussed elsewhere herein. Message activiation could then be achieved by employing a reversibly actuating, lever-action switch with a translatable stamp mount axle as discussed elsewhere herein. Or, for example, the multiple element stamp mount could be manufactured with a seperate pressure sensitive, thin-film switch disposed between the stamp mount surface and the stamp element mounted thereon, for each stamp element location. The operative connection of such a switch could be made via a set of fixed stator contacts, similar to those discussed above, disposed to advantageously engage contacts of the pressure sensitive switches which have been extended to the exterior surface of the axle end of the mount.

Furthermore, as with the cylindrical mount, continuous element stamp: the activation switches, the message generation circuitry, the battery, and speaker mechanisms could all be disposed within a formed interior of the multiple element stamp mount, and activated upon imprinting a desired image or with a pressure switch mounted thereon.

The present invention could employ an additional finger actuated switch, such as a pressure sensitive switch, disposed upon the housing, or upon the mount, of the rubber stamp, and operatively connected, to enable a user to activate the message circuit to generate an effects message as desired, i.e. activation of the message circuit asynchronously with respect to the imprinting of an image. Furthermore, an inhibit switch could be provided on the housing to enable the user to inhibit activation of the message circuit as desired. Such an inhibit switch could be, for example, a normally closed, momentary-contact, push-button switch wired in series with the operative connection of the activation switch, in FIG. 4 470. Also, a volume control could be added to allow adjustment of the volume of the audible message.

3. The Message Circuit

Figure 4:
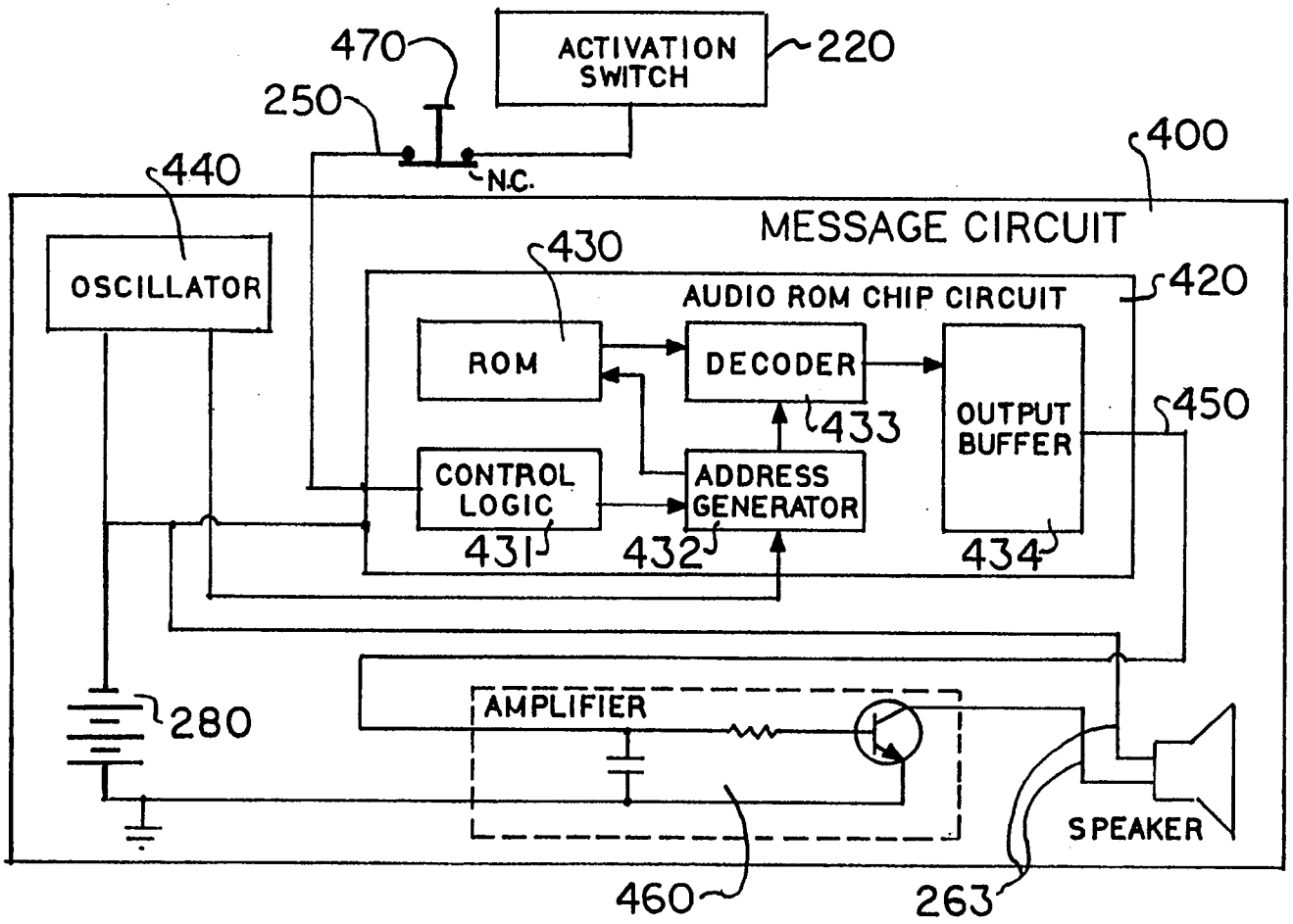
FIG. 4 is a diagram of the message circuit used to generate audible special effects messages of the invention.

FIG. 4 is a block diagram showing an embodiment of the present invention using an electronic circuit 400 to generate an audible message 110. The normally open, lever-action, momentary contact switch 220 is operatively connected to the message circuit 400 via leads 250 which pass through the formed handle 200 of the stamp device 100. The message circuit 400 is typically powered by a 3 to 5 volt battery power supply 410, which is connected to message circuit board 260 via wires 270. In one embodiment of the present invention, the battery power supply 410 remains permanently connected in the message circuit 400. The batteries 280 are replacable via the screw-retained battery compartment cover 285 on the stamp device handle 200. In an alternative embodiment, a power switch (not shown) can be connected in line 270, between the battery supply and the message circuit board components 260. Providing a power switch would allow the rubber stamp device to be used without producing the special effect(s) and allow conservation of battery life when the stamp device is not in use. When the lever-action switch 220 is closed, the audio ROM chip circuit 420 is activated via the operative connection 250. The audio ROM chip circuit 420 has sound effects digitally stored in mask ROM 430 which simulate, for example, a human voice, or an animal, or a machine, or which may be indicative of other sounds. Sounds may be stored as one or more individually playable sound segments, i.e. car sounds could be stored as three individually playable sound data segments: a horn sound, a "peel-out" sound, and a crash sound, whereas, horse sounds might be stored as a single segment representing whinney sound followed a galloping sound. For example, in a stamp with car images, the first actuation of the lever switch could activate the message circuit to play a "honk" the second actuation to play "Varoom . . . screech" and the third "Wham . . . tinkle" or all segments could play consecutively upon each activation of the switch. Other sound effects which may be stored in mask ROM 430 include music, such as that stored in a Nippon Precision Circuits NPC M1130 mask ROM which provides for several minutes of simultaneous dual-note music, for example, Christmas carols. The audio ROM chip circuit 420 is typically a MOSEL MSS0281, or MSS0301 integrated circuit, which is connected to a mask ROM containing a digital representation of the audio special effects message. The MOSEL circuits are available from MOSEL-Vitalic, 3910 N. First St., San Jose, Calif. 95134-1501. The mask ROM 430 sound data is typically ADPCM (adaptive differential pulse code modulation) encoded, but other conventional A/D (analog/digital) encoding techniques may be used. The audio ROM chip circuit 420 works in conjunction with a free-running oscillator 440 to decode and output, on lead 450, a sequence of audio signals, the digital representation of which have been stored in a compressed form in the mask ROM 430. The oscillator 440 is well-known in the art, and is typically a ceramic type oscillator which typically generates a frequency in the range of 400 killohertz to 1 megahertz. The oscillator is connected to the voice ROM chip 420. Mask ROM 430 and the oscillator 440 may be either a part of, or separate from, the voice ROM chip circuit 420. The control logic section 431 of audio ROM circuit 420 detects actuation of activation switch 220 and signals the address generator section 432 to pass the appropriate begining and ending address locations of the compressed stored sound data to the mask ROM 430. Compressed digital sound data is passed from mask ROM 430 to decoder section 433 and output buffer 434 in which it is transformed and converted into an analog form of sound data. The audio signals output from the voice ROM chip 420 pass through an audio amplifier 460 and are applied to a speaker 261 via a first speaker lead 263, so as to be made audible. The speaker 261 also has a second lead 263 which is connected to V+ (lead) of the battery 410.

It is to be expressly understood that the actual circuitry utilized under the teachings of the present invention could be designed using different circuit components and schematics. For example, the FIG. 8 message circuit could be utilized as an alternative circuit for the special effects, rolling stamp device of the invention 100. Different techniques for sound generation could also be utilized under the teachings of the present invention, such as, for example, sound effects circuits based on digital or analog signal generators, mixers and envelop generators, or LPC speech synthesis circuits.

FIG. 8 is a block diagram showing an electronic circuit 800 used to generate an audible message of the multiple element, rotating mount rubber stamp of the present invention.

Multiple inputs of the micro-controller 810 are operatively connected with respective switch contacts of the FIGS. 11 activation switch 1100 as indicated in the diagram of FIG. 11C. Stator contacts 1101-1, 1101-2, 1101-3 of the selection/activation switch 1100 are respectively connected via lines 800-1, 800-2 and 800-3 to the micro-controller 810 of the message circuit 800. Contact 1101-C is connected via line 800-C and is a common line, typically attached to message circuit ground.

When the selection/activation switch 1100 of FIGS. 11A & B is actuated in response to imprinting one of a plurality of images of the multiple element, rotating stamp device 1000, a signal, i.e. voltage level change, is created on one or more of the signal lines 800-1, 800-2, 800-3. Each unique combination of said micro-controller input lines having signals thereon is interpreted by the micro-controller to correspond with a stored special effect sound segment of the device. The micro-controller 810 evaluates, i.e. decodes, the combination of said lines having signals thereon to determine which specific stored sound of a plurality of different stored sounds of the stamp device 1000 is to be generated 1010. The message circuit 800 then generates the appropriate message in a manner discussed elsewhere herein.

As a result of said detected and decoded signal the micro computer program in the micro-controller 810 accesses respective stored audio message information from memory 840. The computer program performs required transformations land manipulations of said message information, for example, reconstructs from the (ADPCM) encoded digital data to digital audio sound for output, and outputs said message information. The micro 810 outputs said digital audio sound message to the input of the DAC device (digital to analog converter) 850 via lines 812 wherein it is converted to an analog type audio message. The audio message is output from the DAC 850 via 851 through an LPF (low pass filter element) and audio amplifier device 860 and via 861 to the speaker mechanism 870 for generation of an audio message 640.

The message circuit of of the multiple element, rotating mount rubber stamp of the invention is shown in FIG. 8. The micro-controller device 810 is a low cost 8 bit micro-controller with appropriate amount of I/O (input/output) and a general instruction set, such as the 80C31 available from many sources: Signetics, Phillips Harris and Intel. The oscillator 815 is well-known in the art, and is selected to have a frequency of 12 MHz to meet design requirements of the micro 810. The latch device 825 is well known in the art, and is used by the microcontroller 810 for addressing the data and code in the memory device 840. The DAC device 850 is also well known in the art, and may be similar to a model AD557 manufactured by Analog Devices. The audio amplifier may be a single chip audio amplifier, such as the well known 386, or a simple transistor driver device.

In order to conserve power, space and/or manufacturing costs, the micro-controller and memory are typically manufactured in a "chip-on-board" fashion. A simple one transistor amplifier 460, as shown in the FIG. 4 message circuit, may be employed alternatively to the audio amplifier 860. The DAC device 850 may be replaced with a R-2R resistor ladder.

The message circuit of FIG. 8 is typically powered by a 5–6 volt battery power supply 880, which is connected to message circuit components through leads 881. A power switch (not shown), incorporated into line 881 so as to control battery power to all circuit components, is recommended. The power switch is used to conserve battery life, reset the system as necessary and to allow use of the stamp device without the generation of audible messages. The batteries are replaced through a screw-retained hatch (not shown) on the rearward facing end of the housing 1005 of the stamp device 1000, as shown in FIGS. 10. The memory device 840 provides the preferred means for storing the computer software, and other data and information required for operation of the stamp activity set of the present invention. Said memory is typically mask ROM digital, non-volatile, memory circuit, such as UM23C256 available from United Microelectronics Corp., 2F, No. 687, Min Sheng East Road, Taipei, Taiwan, R.O.C.; however, said memory device could be PROM, EPROM, EEPROM, battery backed RAM, or other memory device.

The memory device 840 has sound effects digitally stored therein which are used to simulate, for example, a human voice, or an animal, or a machine, or which may be indicative of other sounds. Other sound effects which may be stored in mask ROM 840 include music. In addition to sound data, visual expression data, such as alpha/numeric data, can be stored in mask ROM 840, for example, the names of the stamp images on the respective rubber stamp device or the names and numerals for numbers whose images are on the stamp device. Additionally, indexing/addressing information are stored in mask ROM 840. Such information is required, for example, for the executing software to locate the beginning and ending of respective digital sound data segments within the memory, i.e. the data segment representing the spoken numeral "one" has a unique beginning and ending address, as do the sound data for the other numerals.

Figure 5:
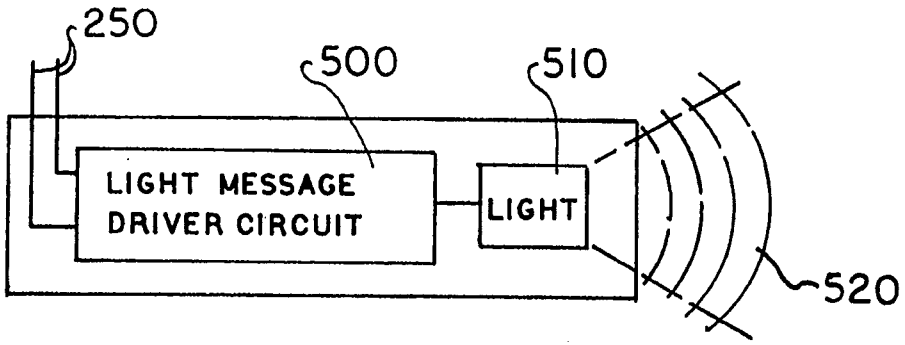
FIG. 5 is a block diagram showing an alternative embodiment of the present invention.

FIG. 5 shows an alternative embodiment of the rubber stamp device of the present invention. In the alternative embodiment, a light message driver 500, responsive to the lever-action switch 220, actuates a visual display 510, such as a liquid crystal display showing a visual or textual message 520. The visual display 510 could also be comprised of light-emitting diodes ("LED"s) or one or more conventional incandescent light sources, representing, for example, a pair of "eyes" corresponding to the eyes of an animal image imprinted by the rubber stamp device 100, or, for example, a circular pattern of lights could be illuminated and extinguished in a sequence to emulate the cylindrical stamp mount 120 rotating 175, as the image is being imprinted 140.

The message circuit of the present invention is not to be limited by the actual circuit design of FIGS. 4, 5, and 8. The message circuit function comprises transmiting a message, or messages in response to the transference of an image, or images, to the medium.

Figure 6:
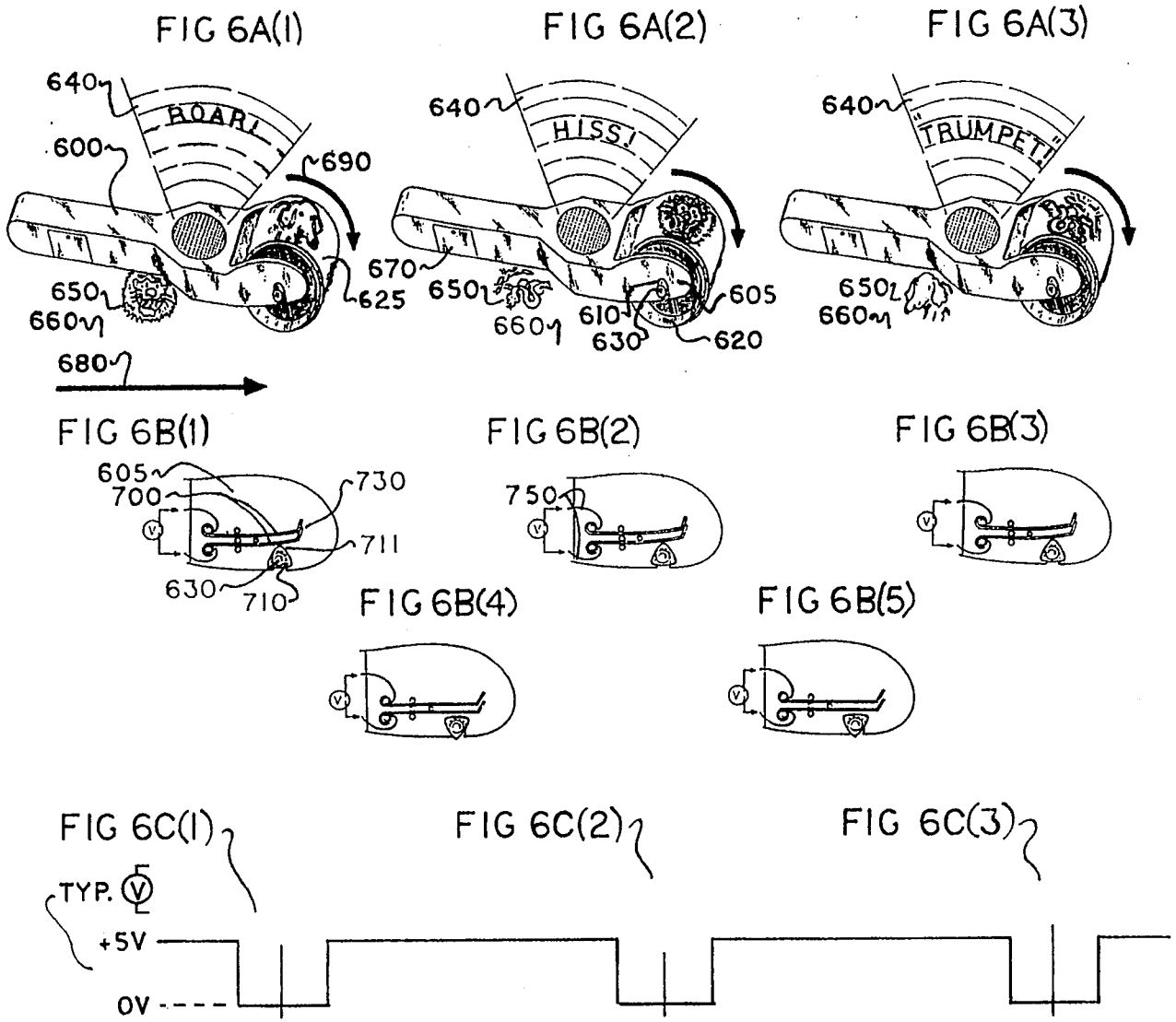
FIGS. 6 are an illustration of a second alternative embodiment of the rotatable cylindrical mount rubber stamp device of the present invention in operation, showing a plurality of audible messages being generated in coordinated response, via the operation of the cam driven activation switch, with imprinting of a plurality of respective images contained on the rubber stamp.

A second alternative embodiment of the continuous element, rotating stamp device of the invention is shown in operation in FIGS. 6A and 6B. The effects stamp device of this alternative sequences the generation of a plurality of effects messages in a coordinated manner with the imprinting of a plurality of respective images of the stamp device. For example, several discrete images are typically disposed along the "length"

of the stamp element of the continuous element, rolling stamp device. These images are seperately imprinted in sequence as the rolling stamp device is "used" i.e. rolled over the medium to imprint one or more images of the entire stamp element. The second alternative special effects rolling stamp device of the invention coordinates the generation of a plurality of effects messages responsive to the imprinting of a plurality of respective discrete images disposed around the continuous stamp element.

In FIGS. 6A(1), 6A(2) and 6A(3) the second alternative embodiment of the special effects rolling stamp is shown in operation. Three images 650 are shown being successively imprinted and three respective audio messages 640 are shown being generated in response therewith as the alternate device 600 is rolled 690 in direction 680 across, and imprinted upon 650, a medium 660. For example, in FIG. 6A(1), imprinting of a Tiger image 650 is accompanied by the playing of a "Roar" sound 640, in FIG. 6A(2) a imprinting a Snake image 650 is accompanied by a "Hiss" 640, and in FIG. 6A(3) an Elephant image 650 by a "Trumpet" sound 640. As the device 600 is pushed in direction 680, the stamp mount 620 rotates 690 and consecutively imprints 650 images from the continuous stamp element 625 and generates special effects 640 which are related to and coordinated with the images. The three images of the example of FIGS. 6A are molded upon a continuous element 625 of device 600. Three related sounds are stored within the device 600 and actuated in a coordinated manner so as to play 640 respectively with the imprinting of images 650.

Figure 7:
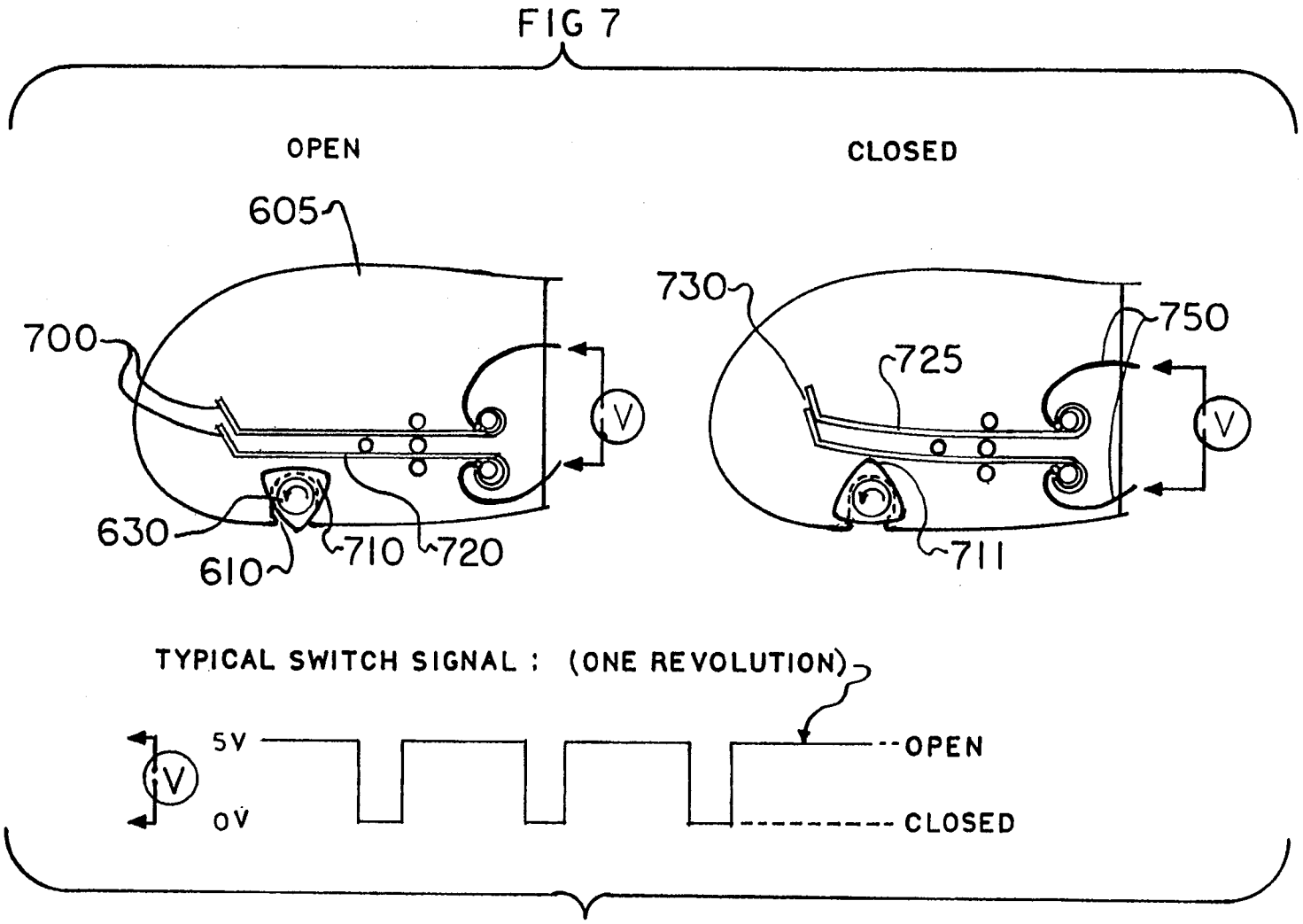
FIG. 7 is a diagram of a cam driven activation switch of the second alternative embodiment.

FIGS. 6B show the operation of the FIG. 7 cam-driven, momentary contact activation switch as images 650 are imprinted from the stamp device 600. The cam-driven switch of the example of FIGS. 6B activates the message circuit to generate a plurality of respective special effects in a coordinated manner with imprinting of a plurality of images. For example, FIG. 6B(1) shows lobe 711 of cam mechanism 710 causing the switch 700 to close 730 in a manner coordinated with imprinting of image 650 of FIG. 6A(1). Said switch closure 730 causes a voltage level change signal 6C(1) to occur on lines 750 thereby generating, via operative connection, a "Roar" sound from the message circuit of FIG. 8. FIGS. 6B(2) and 6B(3) show switch 700 closures respective to the image 650 imprinting positions of the mount 620 of the stamp device 600 of FIGS. 6A(2) and 6A(3). FIGS. 6B(4) and 6B(5) show "open" positions of the switch 700, i.e. no image is positioned for imprinting.

The FIG. 8 block diagram of the message circuit of the multiple element, rotating stamp of the invention is alternatively employed as the message circuit of the second alternative embodiment of the continuous element rolling stamp device. The second alternative embodiment of the invention employs a sensor with the activation switch of the FIG. 8 message circuit, such as a momentary contact, lever-action switch mechanism, shown in FIG. 7, operatively connected via leads 750 to the message circuit 800. Said sensor 700 is comprised of two conductive contacts, an essentially fixed contact 725 and a reversibly deflectable contact 720. The sensor is fabricated in a manner as the switch of FIG. 3. The contacts 720 and 725 of the sensor 700 are affixed within the rotating stamp mount, support bracket (or fork) 605 of the rubber stamp 600 so as to be in active operation with a cam mechanism 710. The cam mechanism 710 is assembled on the axle 630, adjacent to and co-rotational with, a rotating stamp mount 630. The cam and cylindrical mount assembly is rotatably affixed within the fork 605 using axle extensions thereon 630, which extend outward from the center of each side of the stamp mount 620 and into an axle aperature 610 of each arm of the fork 605. It is to be noted, that the axle aperatures 610 of the alternative stamp device are essentially circular, allowing mount/axle rotation, but not allowing "translation" to occur. A reversibly deflectable, conductive lever actuator 720 of the switch 700 rides upon the cam mechanism 710, so as to trigger the electronic circuitry of FIG. 8 to issue the special effects messages 640 in response to the imprinting of the respective visual images 650 from the rotatable, cylindrical mount, continuous element rubber stamp 600 upon the desired medium 660. Note that the activation switch 700 of FIG. 7 is shown using dotted lines in FIG. 8 to indicate that it is an alternative embodiment employing the same message circuit as the preferred embodiment.

As the rotatable, continuous stamp element 625 is rolled across the medium 660 during imprinting 650 thereof, the lever actuator 720 rides "up and down", adjusting to the curvature of the lobes 711 of the co-rotating cam 710. The momentary contact, lever-action switch 700 is; thereby, repeatedly actuated as the fixed contact 720 is deflected, by interaction with the cam lobe 711, to electrically engage 730 with switch contact 725. Such a cam-actuated switch mechanism provides a series of activation signals as the stamp mount rotates, i.e. as shown typically in FIGS. 6C & 7, to activate generation of a series of special effects messages with the imprinting of a series of respective images disposed along the continuous stamp element. By forming and assembling the cam mechanism 710 with the stamp mount 620 and continuous stamp element 625, such that the cam lobes 711 are advantageously associated with the radial disposition of the stamp images around the continuous element 625, the activation switch signals 830 and resultant special effects messages 640 are made temporally proximate to the imprinting of the respective images 650 on the medium 660. Notice that the "advantageous" association of switch activation and image imprinting of the example of FIG. 6, causes audible messages 640 to be generated as the respective imprinted images 650 emerge from beneath the stamp device. The physical coordination of imprinting an image and generation of the related effects messages is selected by the device designer to create the most novel experience.

The generation of a plurality of sound messages in a coordinated manner with the imprinting of respective images is used, for example, to play a simple musical score as the respective notes are imprinted, or to render a sequence of animal sounds as the respective animal images are imprinted, or to "speak" the numbers from "one" to "ten" as the respective numerals are imprinted. Additionally, the rate of passing of cam lobes, ie. as continuous stamp element images are imprinted, can be used to control other aspects of the special effects message. For example, the message playout frequency can be modulated based on the speed at which the rubber stamp images are being imprinted, i.e. the rate of "falling edges" in the associated activation switch signal signal, for control of "Kazoo" "siren" "scream" or racecar "fly-by" sounds. The special effects message(s) could also be a sequence of lights or "LEDs", or other visual display, such as an LCD presentation.

It is expressly understood that a cam mechanism could be formed as a part of the continuous stamp element itself, by etching away portions of the edge of the stamp element along its length to form the cam lobes and by employing a roller type switch lever actuator to track up and down with the etched lobes along the continuous length of the stamp element as the cylindrical mount mechanism and affixed element rotate during imprinting. In this alternative a roller-lever, snap-action type switch, such as a Unimax 2HCA1, could be employed to facilitate "following" the contour of the rubber material.

It is understood, that from time to time, when employing a cam-driven type switch, the message circuit might "miss" a particular switch actuation or for other reasons lose proper correlation between a respective effects message of a sequence and a concurrently imprinted image, such as, for example, due to nearby static electricity interference. It is expressly understood that many techniques may be employed within the present invention to maintain the proper correlation between the effects messages of a sequence and the imprinting of the respective images of the continuous stamp element. For example, a second cam switch mechanism having an advantageously disposed, single lobe could be employed to automatically maintain said correlation during each revolution of the cylindrical mount mechanism, or an aforementioned inhibit switch could be employed by the user to correct any sequencing mismatches which might arrise from time to time. Furthermore, the power switch of the invention can be utilized to "initiallize" the message circuit 800.

The message circuit 800 detects actuation of the FIG. 7 cam driven, lever-action activation switch mechanism 700 and issues predetermined audible messages 640 and, alternatively, visual messages in response thereto. The normally open, momentary contact switch 700 of the rubber stamp device 600 has one contact electrically connected to system ground and the other to an input port of the micro-controller device 810 of the message circuit 800 via leads 750. The physical conductive pathway of said leads consists of: two wire conductors electrically connected repsectively to two terminals of the normally open contacts of said momentary-contact switch, said wires passing from said switch through a cavity in the housing of the stamp device 600 to where they electrically connect to two terminals of the message circuit 800, said conductive pathway then passing from said circuit terminals, via circuit board runs, and proceding such that one said run is connected to system ground and the other to an input port 811 of the micro-controller 810. Note that the system works best if the input port used is a hardware interrupt port, i.e. when the message generation is interrupt driven.

When a signal, typically the changing of a voltage level 830, is detected by the micro controller 810 on input port 811, it is interpreted by the executing computer code therein as resultant from the actuation of momentary-contact switch 700. Note, that the detection by the message circuit 800 of the cam switch 700 actuation signal occurs as detection of the CHANGING of the voltage signal, i.e. "edge trigger" in the example of FIGS. 7 & 8, a "falling edge" 831. This is important since the cam driven switch may occasionally remain in the "closed" position depending upon the position of the cam when the stamp is at rest. Other physical interlock switching is possible to prevent continuous activation; however, nearly all micro controllers and ROM playout circuits can be edge triggered, i.e. will capture a falling or rising edge, thus simplifying the switching and software design. As a result of said detected signal the micro computer program accesses respective stored audio message information from memory 840. The computer program performs required transformations and manipulations of said message information, for example, reconstructs from the (ADPCM) encoded digital data to digital audio sound for output, and outputs said message information. The micro 810 outputs said digital audio sound message to the input of the DAC device (digital to analog converter) 850 via lines 812 wherein it is converted to an analog type audio message. The audio message is output from the DAC 850 via 851 through an LPF (low pass filter element) and audio amplifier device 860 and via 861 to the speaker mechanism 870 for generation of an audio message 640.

The computer software of the second alternative invention counts the number of switch actuations, i.e. "falling edges" 831, and accumulates this count in the modulus defined by the number of distinct messages available to be played in sequence, correlating to the images available to be imprinted during a complete rotation of the respective stamp element. For example, if five "speech" messages are stored in memory 840, allowing the message circuit to audibly "recite" the numbers 1 to 5, in coordinated response to imprinting numeral images "1"–"5" disposed along the length of the stamp element, then the modulus is 5. For each count, i.e. detected activation signal, there are address pointers stored in memory which indicate the beginning and ending locations of the appropriate stored sound message data segment. As the stamp is imprinted, the software determines the count, accesses the appropriate stored message segment and plays it out in the manner described above. Alternatively, the message could be a visual message accessed from memory and displayed via a visual display device, such as an LCD, or an illuminated sequence of "LEDs". Additionally, the software determines the rate of activation switch actuations and may be configured to adjust the playout rate, i.e. bits per second to the DAC 850, in response thereto. The software can be configured to playout each message at a predetermined rate, interrupting a currently playing message with a successive message as necessary, if, for example, the imprinting rate exceeds the playout of the respective audio message. This configuration is appropriate, for example, for a stamp reciting numbers as the corresponding numerals are being imprinted. The software can be configured to adjust the playout rate of a currently playing messages relative to the speed of imprinting, i.e. effectively modulating the message signal frequencies. This interesting effect can be effectively applied, for example, to a stamp device of the invention in which the images and sounds are related to automobile racing. Expanding on an example given above, a simple musical score can be rendered at differing "tempos" and/or with the notes therein played at differing pitches.

The effects stamp device of the second alternative embodiment of the invention can also be designed to play different sound segments for successive "uses" of the stamp device. This is achieved, for example, by combining the activation switch of the preferred embodiment of the rolling stamp device, FIG. 3, with the message circuit of the second alternative embodiment of the device. In this alternative arrangement, for example, upon the first use of the rolling stamp device to imprint racing car images therefrom, "peelout" sounds are played, upon the next imprinting of the raceing car images "flyby" sounds are played, and upon the third imprint of the stamp device "cheering" sounds are played out. The racecar sound message segments are generated in sequence upon three successive "uses" of the stamp device.

Figures 9B, 9C:
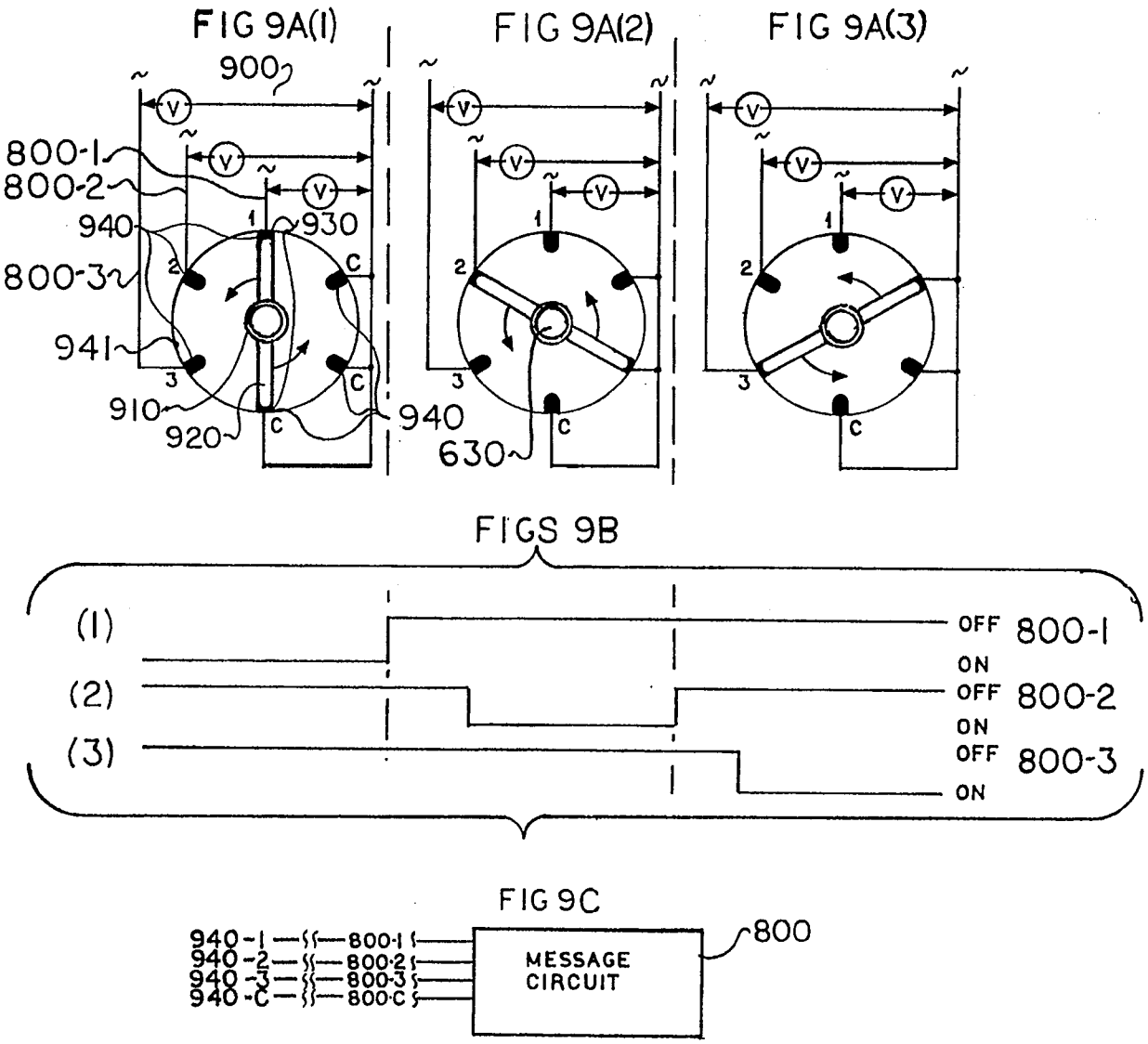
FIGS. 9B depict respective voltage signals on lines connected to the alternative rotary switch mechanism when different switch positions are selected.
FIG. 9C is a block diagram of operative connections of the switch of FIGS. 9A to the FIG. 8 message circuit.
Figure 10A:
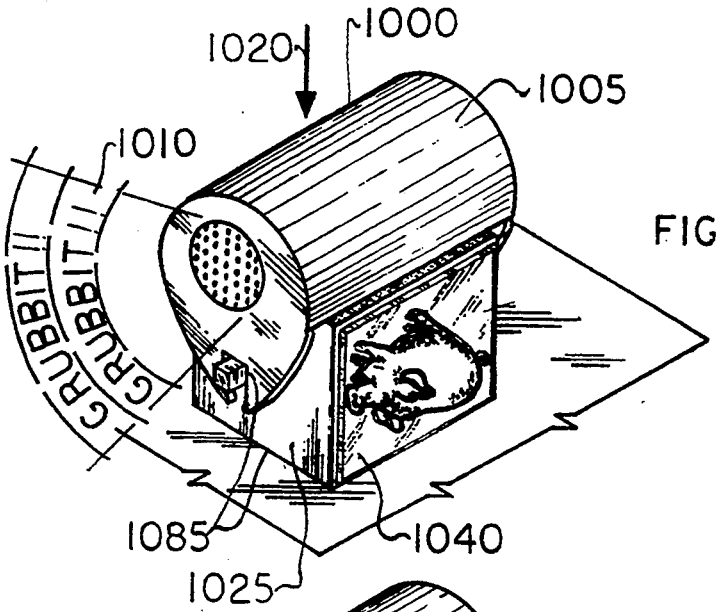
FIG. 10 (*a*) is an illustration of the rotatable mount, multiple element rubber stamp device of the present invention in operation, showing an audible message being generated in response to the imprinting of an image contained on the rubber stamp.
Figure 10B:
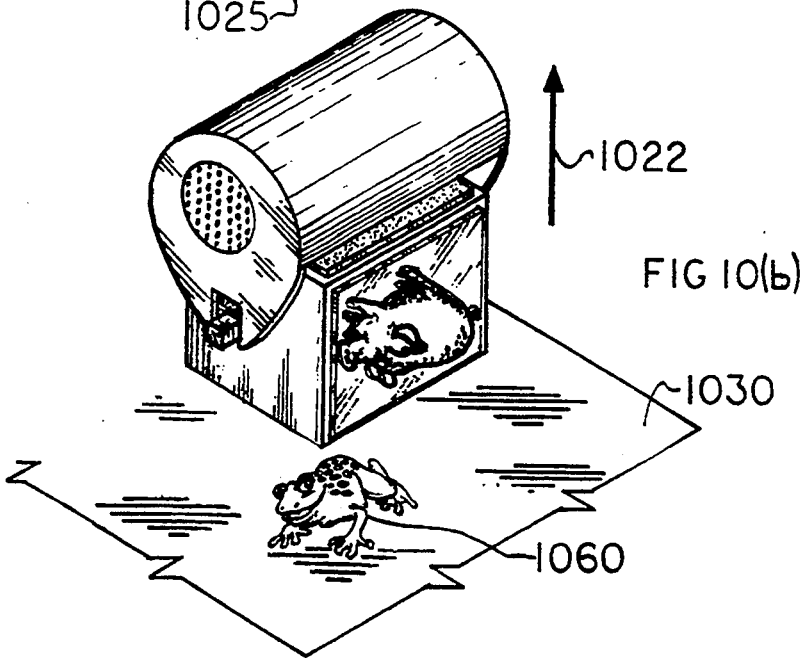
Figure 10C:
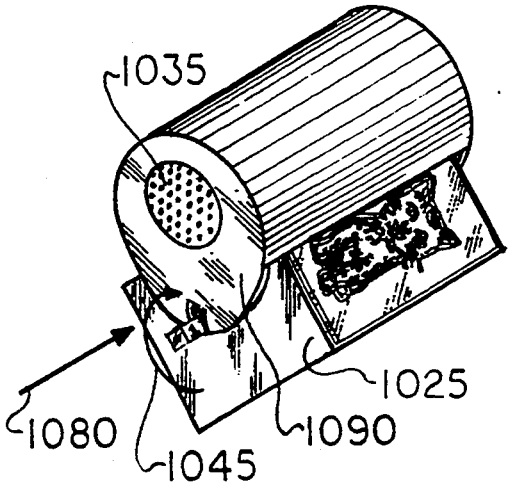
Figure 10D:
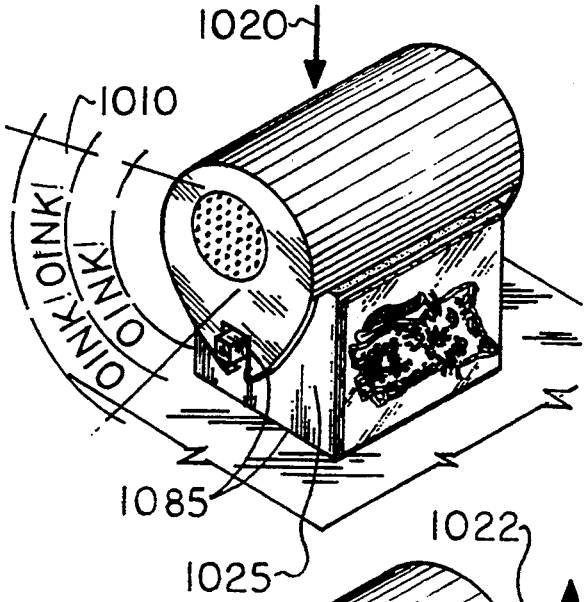
Figure 10E:
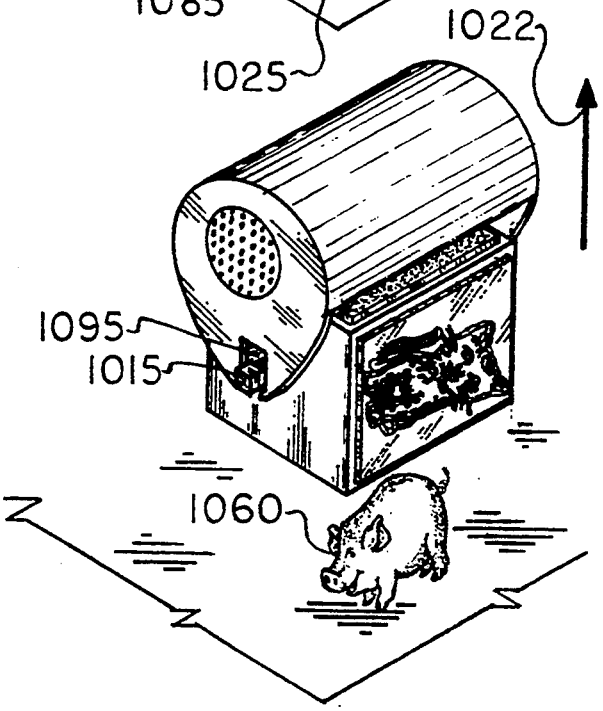

It is to be further understood that other switch mechanisms could be employed within the second alternative embodiment of the present invention to generate a plurality of effects messages in response to imprinting a plurality of respective images of the alternative rolling stamp device. A switch could be employed which would activate, i.e. put a signal on, a seperate operative line for each message which is to be activated in response to its respective image imprint. For example, a two pole rotary switch 900, of FIGS. 9A(1 . . . 3), could be employed in which a control shaft 910 and an attached rotor contact 920 are co-rotational with the rubber stamp cylindrical mount 620 and the axle thereto 630, and in which, for example, the rotor contact 920 of the switch engages its two pole stator contacts 930 at 180 degrees. The rotary switch control shaft 910 in this case could be a hollow shaft which is fit tightly about the mount axle 630 so as to maintain said co-rotation. In such a switch, a consecutive one-half of the stator contacts 940 are individually operatively connected to a plurality of respective inputs of the message circuit 800, of FIG. 9C, wherein a signal detected from a given switch contact will control the activation of its respective sound message. The remaining one-half of the stator contacts of said rotary switch 940-C, i.e. the respective, consecutive second poles of the switch, are connected to the system ground. As the cylindrical stamp mount 620 and axle 630, and hence the switch control shaft 910 and rotor contact 920, rotates, the rotor contact 920 of the switch sweeps from stator contact 940 to stator contact 940, consecutively putting a signal (voltage change) on each respective message activation line. FIGS. 9B depict voltage signals on lines 800-1, 800-1 and 800-3 as the rotor contact 920 is rotated to the three positions shown in FIGS. 9A(1), 9A(2) and 9A(3). For example, in FIG. 9A(1), rotor contact 920 bridges 930 stator contacts 940-1 and 940-C and the resulting voltage signal change is shown in 9B(1) for line 8001. In practice, the radial locations of stator contacts will need to be advantageously associated with the radial disposition of the images around the continuous stamp element for which respective effects messages are to be generated. The stator contacts 940 are disposed upon a non-conductive media 941, such as phenolic composition, which is affixed to the stamp mount bracket 605. Note that a two pole, rotary switch with multiple sets of contacts, similar to that of FIGS. 9A, could be employed in the multiple element, rotating mount stamp 1000 to select special effects in a coordinated manner with the selected image.

The FIG. 8 message circuit may employed with the alternative rotary type activation switch of FIGS. 9A of the invention, as depicted in FIG. 9C. For example, the stator contacts 940-1, 940-2 and 940-3 are operatively connected to the message circuit via lines 800-1, 800-2, and 800-3. The "common" lines 940-C are connected via 800-C. When the activation switch of FIGS. 9A is actuated while imprinting one of a plurality of images on the continuous element rolling stamp device 600, for example, a signal, depicted in FIGS. 9B, is created on one of the input lines 800-1, 800-2, or 800-3. Each of said input lines is interpreted by the micro 810 to correspond with different stored special effects sound segment of the device. The micro-controller 810 continuously evaluates said lines to determine when a specific line carries a signal, such as, for example, as shown in FIGS. 9B. When a signal is detected the respective stored sound of a plurality of different stored sounds of the stamp device is accessed and the message circuit 800 generates the appropriate message in a manner discussed elsewhere herein.

Other message circuit designs may be used with the invention when employing alternative sensor switch mechanisms, such as those of FIGS. 9 & 11. A voice ROM chip circuit having direct hardware addressability of multiple sound segments may be a more cost effective approach to implementing the invention herein disclosed. Such a multi-segment voice ROM chip as the OKI MSM6373, available from Oki Semiconductor, 785 N. Mary Avenue, Sunnyvale, Calif. 94086 or multisegment ROM sound chips from Mosel, mentioned earlier could be employed. The MSM6373, if used with a rotary, or similarly actuating switch, as discussed elsewhere herein, would replace the 8031 Micro device, the 23C256 ROM device, and the 557 DAC device. The MSM6373 is capable of playing a plurality of messages in an externally controlled, sequenced manner; however, it may not, in general, be capable of more flexable adaptations, such as, frequency modulating messages, or of driving a visual display device without the addition of external components.

It is expressly understood that many different techniques for digitizing, storing and regenerating original, real-life sound are appropriate for use within the present invention. For example, the well known ADPCM method of digital sound data compression utilizes a transformation which reduces the amount of stored digitized sound data required, by storing the differences in value between adjacent sound samples rather than the absolute value of each sample. The transformation is reversed during playout to regenerate an effective rendition of the original real-life sound. Also, the well known technique of Linear Predictive Coding LPC utilizes a transformation on the digitized version of the original sound data from which only a series of codes are stored and these codes are used to control a digital filter system which regenerates the original real-life sound based on vocal tract modeling scheme. It is also possible to employ under the control of the message and control circuit a sound synthesis circuit which contains its own analog and/or digital operational characteristics for the creation of real-life sound renditions.

The methods by which, and the criteria for which, speech data, sound effects data, music data, and visual data are stored and regenerated are very extensive. It is not the intention here to give an exhaustive presentation of application of such methods or criteria to the present invention. Many methods and technologies are available for storing and generating audio and/or visual messages in response to the creation of imprints of graphic images and it is assumed that those skilled in the art will employ a variety of said methods under the teachings of the present invention.

Finally, in FIG. 8, an optional data port 890 is shown interconnected over lines 891 to RD, WR I/O ports 892 of micro-controller 810 and to ground of the message circuit 800. This port provides a convenient function for the user of a stamp device of the invention. It allows a stamp device 100, 600, or 1000, of the invention to be connected to a standard personal computer, in FIG. 8 896, or other digital programming device, in order to store custom special effects into the memory of message circuit 800. For example, this data port allows a user to store his own a happy birthday message, such as "happy birthday Johnny" on a stamp having a birthday theme image. When the stamp device, for example of FIG. 1, is imprinted 140, the user-stored effects message 110 "happy birthday Johnny" plays. A switch 893 is provided to select either a "play" mode 894 or a "programming" mode 895 of the micro-controller 810 of the message circuit 800. Other special effects data and control information could be stored using the I/O port. For example, textual information to be displayed via an LCD of the stamp device upon imprinting could be stored using the I/O port. Furthermore, a personal computer, or other digital programming device, could be located at a retail outlet at which effects stamps of the invention are sold; thereby, allowing customers to store their own unique effects stamp messages where they purchase an effects stamp. The aforementioned Signetics 80C31 micro-controller, which has a complete serial port built-in, could be utilized as the microcontroller 810 in this alternative. The memory device 840 could be battery-backed RAM. Other alternative sound chip circuits are available, such as the MSM6378 One-Time-Programmable speech chip from Oki which is utilized in conjunction with a data programmer device from the same company. Note that the programmable message circuit alternative of FIG. 8 could be employed in a single element special effects hand rubber stamp.

Figure 13:
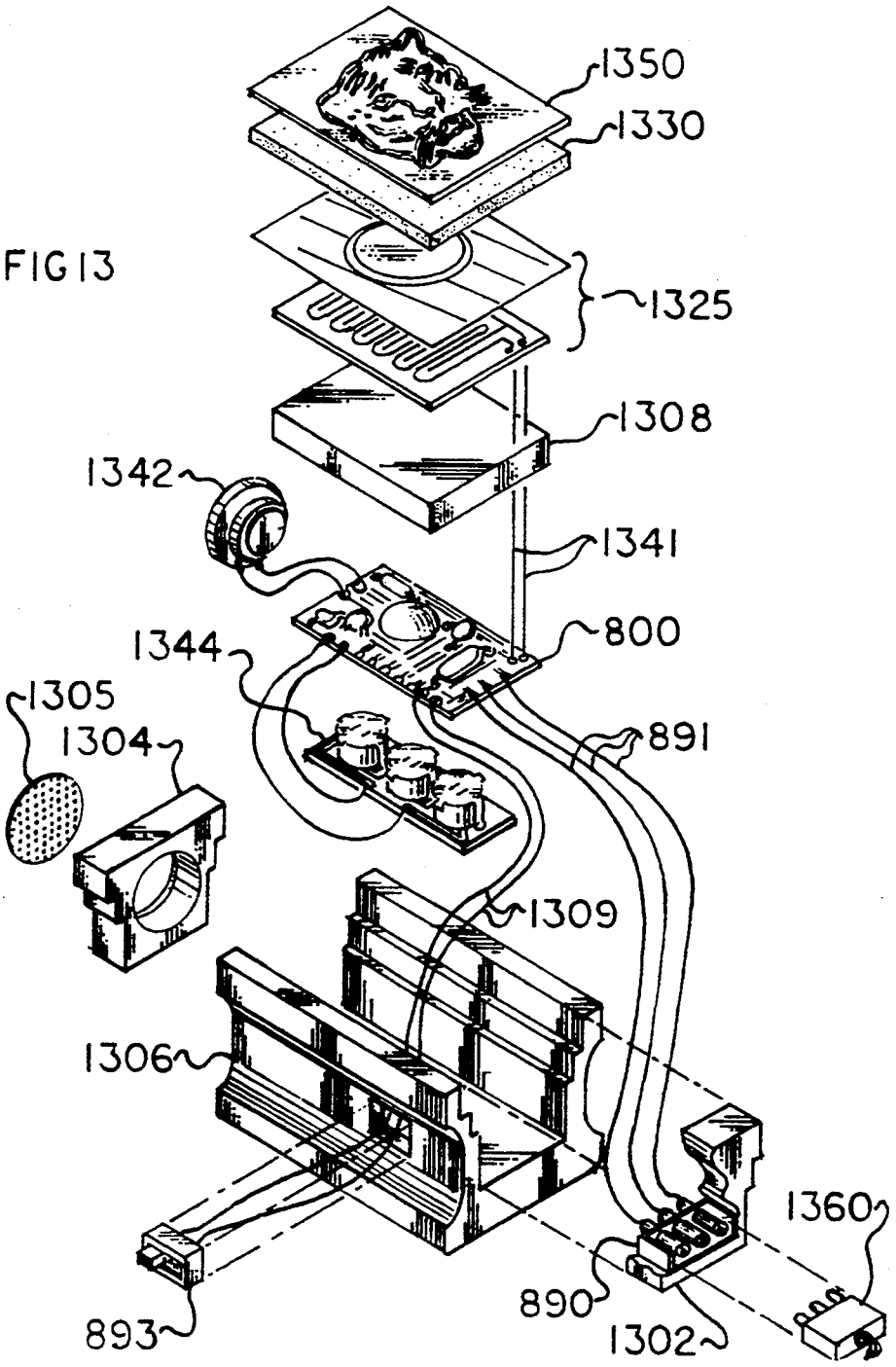
FIG. 13 shows a partially cut-away, exploded perspective drawing of a single element special effects hand rubber stamp device with a data port for loading custom effects messages into a message circuit thereof.

FIG. 13 shows an exploded and partially cut-away drawing of a single element special effects hand rubber stamp device employing a data port 890 for loading custom effects messages into a message circuit 800 thereof. The special effects rubber stamp of FIG. 13 is comprised of a housing formed of two end pieces 1302, 1304, a shell/handle 1306 and a stamp element backing plate 1308. The shell 1306 is formed to accommodate a message circuit 800, a battery power supply 1344, the end pieces 1302, 1304 and the backing plate 1308. The shell 1306 is further formed to accommodate the "play/program" mode selection switch 893 of the device. The switch 893 is operatively connected to the message circuit 800 via lines 1309. One end piece 1304 is formed to accommodate a speaker 1342 and grill 1305. The other end piece 1302 is formed to accommodate a data port 890 which is operatively connected to message circuit 800 via lines 891. The backing plate 1308 for the stamp element 1350 is affixed to form the bottom of the shell 1306. A thin-film, pressure sensitive activation switch assembly 1325 is disposed between the backing plate 1308 and the stamp element 1350 so as to be actuated upon imprinting of the stamp device of FIG. 13. The switch 1325 is operatively connected to the message circuit 800 via lines 1341. A foam backing pad 1330 and stamp element 1350 are mounted upon the switch 1325 and backing plate 1308 with adhesive. When the stamp device is imprinted, while switch 893 is in the "play" mode position, the message circuit 800 is activated to play a special effects message. When mode switch 893 is in "program" mode position a custom special effects message can be downloaded into the message circuit 800 via data port 890. The custom message is loaded from a remote computer or other digital programming device via a compatible port connector plug 1360 connected thereto. The downloaded custom message is played via speaker 1342 when the mode switch 893 is in the "play" position and the stamp device of FIG. 13 is imprinted.

It is to be expressly understood that the actual circuitry utilized under the teachings of the present invention could be designed using different circuit components and schematics. The message circuit of the present invention and alternative embodiments thereto, are not to be limited by the actual circuit designs of FIGS. 4, 5 and 8.

4. Construction of the Rubber Stamp Device

In the preferred embodiment, the rubber stamp device 100 is typically constructed from plastic, since low cost and mass-production are requirements for the market. The present invention is designed to be easily and inexpensively manufactured in large quantities.

The cylindrical stamp mount 120 and the housing, which comprises the formed handle 200, message circuit and component cavity 201, the battery compartment 281 and formed bracket for the rotatable, cylindrical mount mechanism 205, are typically constructed using low cost, rigid plastic material, such as polystyrene or ABS, and using injection molding process. The formed housing is molded as two side sections, vertically defined, approximately, along the long axis midline 202. The battery compartment cover 285 is molded as a separate piece. Molding the device housing in its two sides allows for the convenient formation of the battery compartment walls, mounting bracket extensions for the message circuit board 260, lever-action switch components 220 and speaker 261, and the elongated aperatures 240 for the stamp mount axle 230. Additionally, the stamp device assembly is enhanced, particularly with respect to affixing the lever-switch components 220 within the stamp mount bracket extension 205. Furthermore, a more rigid, and rugged handle results than would be the case if the housing sections were molded, for example, as top and bottom sections.

Each of the molded side parts of the housing are formed to have one branch of the support bracket extension of the bifurcated, rotatable mount support of the assembled housing of the stamp device. It is expressly understood that the two support branches could be formed so as to come up and over the attached rotatable mount in the final assembled piece, i.e. like a "fender" or "bonnet" without interfering with the rotation or imprinting thereof. Such a "fender" could strengthen the support brackets 205 and protect the user from inadvertently getting ink on his/her hands during operation of the stamp device.

The message circuit board 260 and speaker mechanism 261 are easily sliped onto formed brackets 262 of the exposed cavity interior 201 of the formed housing. The activation switch components 220 are likewise easily slipped onto their respective mounting bosses 221 extending from the exposed interior of the axle bracket area 205 of the housing. Wires of the operative connection 250 are typically either fused to the switch contacts 220 prior to assembly of the contacts onto the mounting bosses 221, or the wires may be held permenently against the contacts 220 by wedging the wires between the contacts 220 and their respective mounting bosses as they are assembled. In addition to mounting bosses, guide boss extensions 221A are also provided on the mount bracket 205 to assure predetermined force for actuation and to hold the switch contacts properly in-place during operation. It is expressly understood that other switch mounting designs could be utilized in the invention, including an adjustable mount for adjustable control of the lever deflection force. A counter-balance spring-lever, if required, is mounted on bosses extending from the -opposing side support bracket 205. The activation switch components are permanently affixed in place by melting the exposed portions of their plastic mounting bosses down over the components, in-place 222 (this could include the operative wire components as well). The two sides of the housing 200 are glued together, or they may be designed to be attached with screws.

The rubber stamp element is formed on a flat mold, from a semi-porous rubber material normally used for rubber stamp devices. The rubber stamp element is trimmed to fit and is glued in place around the arcuate surface circumferance of the cylindrical mount. Cushion pads are normally not used, since the assembly process is difficult regarding the tolerance requirements around the arcuate surface, and the forces involved during imprinting will tend to cause the glue to fail in the long-term, whenever there is too much motion of the stamp element. Care must be taken in trimming the rubber stamp element 160 which must attach firmly around the cylindrical mount 120 with its opposite ends meeting exactly and squarely in a manner that it can be considered a continuous element from an operational point of view. Additionally, particularly in the second alternative embodiment of the invention, care must be taken in stamp design in arranging the locations of images along the element, and in stamp fabrication in assembling the element to the mount, to insure proper correlation of the effects message with the respective image. The axle extensions of the cylindrical mount mechanism are snaped into the opposing slot aperatures 240 in the brackets 205.

The multiple element, rotatable mount stamp device of the invention is shown in FIG. 10. The housing 1005 is formed into a cylinder-section shaped handle portion with two stamp mount brackets 1090 extending parallel from the ends of the handle and perpendicular to the flat cylinder section surface thereof, i.e. typically "downward" in operation. At the "lower" end of the mount brackets rectangular aperatures are formed for the translatable/locking axle 1015 of the stamp mount. The formed housing 1005 is manufactured from rigid, low-cost plastic, such as polystyrene or ABS and is injection molded. The housing 1005 is molded as two approximately equal sized cylindrical "sub" sections of the handle 1005 and each including stamp mount bracket half-section extensions. The cylindrical sub-section handle halfs are defined by a plane section perpendicular to the plane of the assembled handle 1005 section, positioned in the center and cutting the long axis midline thereof and, further, extending "downward" through the stamp mount brackets, i.e. perpendicular to the plane thereof. A speaker mount and grill mount 1035 are molded on one end of the assembled handle. Within the other end, a battery compartment is molded. A screw-retained plastic battery compartment cover is molded seperately. Molding the device housing in its two sides allows for the convenient formation of the battery compartment walls, mounting brackets for the message circuit board, translatable stator switch component brackets, speaker brackets, and the elongated, rectangular aperatures for the stamp mount axle. Additionally, the stamp device assembly is quick and convenient.

The stamp mount of the multiple element stamp device is typically formed from wood as a rectangular block having two opposing square ends. The axle extensions can be conveniently made by utilizing two advantageously sized, square-headed wood bolts with smooth, circular shank portions. The bolts are driven into the centers of the opposing square ends of the mount. The locking/rotating operation of the stamp mount may be understood by refering to FIGS. 12. Traditional rubber stamp elements are mounted on the four rectangular faces of the mount. The axle extensions 1015 are snapped into place within the opposing rectangular aperatures of the assembled housing 1095.

It is expressly understood that the stamp mount of the invention could be formed using other methods and materials, including, for example, molding the stamp mount and axle from plastic material. The mount of the invention could, additionally, be formed to accommodate a greater or lesser number of stamp elements. Furthermore, there are many mechanisms which will enable a multi-element stamp mount to be reversibly locked and rotated to provide for image selection and image imprinting. For example, a spring driven, rounded-tip, bolt device operating perpendicular to the inside surface of the mounting bracket could reversibly extend into groves advantageously placed in the opposing flat surface of the stamp mount.

The foregoing descriptions of the invention and suggested extensions thereof has been presented for the purpose of illustration and description. It is not intended to be exhaustive or to limit the invention to the precise forms disclosed. Many modifications and variations are possible in light of the above teaching and it is expected that those skilled in the art can and will devise variations of the present invention which nevertheless fall within the scope of the appended claims. It is intended that the scope of the invention be limited not by this detailed description, but rather by the claims appended hereto.

I claim:

1. A rotatable image transfer device capable of generating an imprinted reproduction of at least one image to a target object comprising:

an image mount, a housing having a formed interior region, means to rotatably attach said image mount to said housing, means affixed to said rotatably attached image mount for transferring said imprinted reproduction of said at least one image to said target object responsive to contact with said target object; and means, disposed substantially within said formed interior of said housing, responsive to said contact between said transferring means and said target object, for generating at least one non-imprinted message in response to said transfer of said at least one image to said target object, said at least one non-imprinted message specifically associated with said at least one image, means in said generating means and in said formed interior for storing said at least one non-imprinted message.

2. The device of claim 1, wherein said image transferring means is an ink stamp.

3. The device of claim 1, wherein said at least one non-imprinted message is generated at a time substantially occurring to when said contact between said transferring means and said target object is effected and, wherein, means are provided, in said responsive means, requiring said contact be said effected with a predetermined amount of force.

4. The device of claim 1, further comprising means disposed upon said housing for generating said at least one non-imprinted message with respect to said transfer of said at least one image to said target object.

5. The device of claim 1 further comprising means to translatably attach said rotatably attached image mount to said means to rotatably attach an image mount to said housing.

6. The device of claim 1, wherein said generating means includes a lever-action switch responsive to said contact, said switch comprising a pair of contact elements, a fixed contact element and a bridge contact element, said bridge contact element providing an electrically conductive path between said contact elements when said contact with said target object is effected with a predetermined amount of force.

7. The device of claim 1, wherein said generating means comprises means for producing a visual indication.

8. The device of claim 1, wherein said generating means comprises a plurality of light emitting elements.

9. The device of claim 1, wherein said generating means comprises means for producing an audible sound corresponding to said message.

10. The device of claim 1 further comprising a communications port connected to said generating means and a remote computer selectively engaging said communications port for storing said at least one non-imprinted message into said means for storing said at least one non-imprinted message.

11. The image transfer device of claim 1 wherein said housing is formed from plastic.

12. The image transfer device of claim 1 further comprising means connected to said generating means for selectively inhibiting the operation of said generating means.

13. The image transfer device of claim 1 wherein said transferring means is constructed from rubber.

* * * * *